US007628647B2

(12) United States Patent
Semba et al.

(10) Patent No.: US 7,628,647 B2
(45) Date of Patent: Dec. 8, 2009

(54) COAXIAL CABLE AND METHOD FOR MANUFACTURING THE SAME

(75) Inventors: Hiroyuki Semba, Tochigi (JP); Takayoshi Koinuma, Tochigi (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/877,276

(22) Filed: Oct. 23, 2007

(65) Prior Publication Data

US 2008/0139046 A1 Jun. 12, 2008

(30) Foreign Application Priority Data

Oct. 23, 2006 (JP) ..... P.2006-288056
Oct. 23, 2006 (JP) ..... P.2006-288057
Apr. 24, 2007 (JP) ..... P.2007-114806

(51) Int. Cl.
*H01R 9/05* (2006.01)

(52) U.S. Cl. ..... 439/579

(58) Field of Classification Search ..... 439/578, 439/579, 497, 498, 499
See application file for complete search history.

(56) References Cited

U.S. PATENT DOCUMENTS 2,286,759 A * 6/1942 Patnode ..... 72/46
3,267,410 A * 8/1966 Baer et al. ..... 439/680
3,811,311 A * 5/1974 Barone et al. ..... 72/278
3,958,852 A * 5/1976 Abraham et al. ..... 439/355
4,605,276 A * 8/1986 Hasircoglu ..... 439/465
5,281,762 A * 1/1994 Long et al. ..... 174/78
5,811,735 A * 9/1998 Quiroz ..... 174/117 F
5,980,308 A * 11/1999 Hu et al. ..... 439/497
6,031,185 A * 2/2000 Bouveret et al. ..... 174/84 R
6,124,550 A * 9/2000 Funken et al. ..... 174/78
6,216,513 B1 * 4/2001 Nakamura et al. ..... 72/148
6,273,753 B1 * 8/2001 Ko ..... 439/579
6,305,978 B1 * 10/2001 Ko et al. ..... 439/579
6,705,896 B1 * 3/2004 Chang et al. ..... 439/610
6,793,527 B2 * 9/2004 Noro ..... 439/579

(Continued)

FOREIGN PATENT DOCUMENTS

JP 07-192541 7/1995

(Continued)

OTHER PUBLICATIONS

Japanese Notification of Reasons for Refusal, with an English translation thereof, issued in Patent Application No. JP 2006-288057 dated on Sep. 3, 2008.

(Continued)

*Primary Examiner*—T C Patel
*Assistant Examiner*—Harshad C Patel
(74) *Attorney, Agent, or Firm*—McDermott Will & Emery LLP

(57) ABSTRACT

In each of plural coaxial cables 11, a tip portion of an outer sheath 12 is removed and portions of an outer conductor 13, an insulator 14, and a center conductor 15 are exposed in this order in a step-like manner. A ground bar 20 having lock nails 23 for locking the coaxial cables 11 individually is fastened to the exposed portions of the outer conductors 13. The coaxial cables 11 are fixed being sandwiched between the ground bar 20 and a pressing member 13.

10 Claims, 15 Drawing Sheets

U.S. PATENT DOCUMENTS

| | | | | |
|---|---|---|---|---|
| 6,840,792 | B1 * | 1/2005 | Kuan | 439/404 |
| 6,890,191 | B1 * | 5/2005 | Thorburn | 439/98 |
| 7,377,803 | B2 * | 5/2008 | Matsuoka | 439/497 |
| 2003/0114046 | A1 * | 6/2003 | Noro | 439/579 |

FOREIGN PATENT DOCUMENTS

| | | |
|---|---|---|
| JP | 2000-228118 | 8/2000 |
| JP | 2005-209613 | 8/2005 |
| JP | 2005-302604 A | 10/2005 |
| JP | 2006-049261 | 2/2006 |
| JP | 2006-066153 | 3/2006 |

OTHER PUBLICATIONS

Japanese Notification of Reason for Refusal, w/ English translation thereof, issued in Japanese Patent Application No. JP 2007-114806 dated on Oct. 15, 2008.

* cited by examiner

Prior Art

COAXIAL CABLE AND METHOD FOR MANUFACTURING THE SAME

BACKGROUND OF THE INVENTION

The present invention relates to a coaxial cable and its manufacturing method. For example, the invention relates to a coaxial cable capable of connecting coaxial cables directly to, for example, interconnections provided on a substrate without intervention of a connector, as well as to its manufacturing method.

An electric connector for connecting plural coaxial cables to interconnections on a substrate is known (refer to Patent document 1, for example).

As shown in FIG. 9, this electric connector 100, which is to connect coaxial cables 101 electrically to a receptacle (not shown) by fitting the former into the latter, is provided with an insulator housing 102 made of a synthetic resin such as plastics, plural conductive terminals 103 which are arranged at a prescribed pitch in the width direction of the housing 102, and a shield plate 104 which covers the housing 102 from above. The conductive terminals 103 are positioned with respect to and placed in housing recesses 105 which are formed at a prescribed pitch adjacent to each other in the width direction of the housing 102. Each coaxial cable 101 to be connected to a conductive terminal 103 is composed of a center conductor 107 to be connected to the conductive terminal 103 with solder or the like, an insulator 108 which surrounds the center conductor 107, an outer conductor 109 which surrounds the insulator 108, and an outer sheath 110 which surrounds the outer conductor 109. The center conductors 107 of the coaxial cables 101 are connected to the corresponding conductive terminals 103, respectively, and the outer conductors 109 are connected together by means of a caulking member 111.

[Patent document 1] JP-A-2005-302604

Incidentally, in a coaxial cable used in a cell phone or the like, cables are connected to other cables or a substrate or the like via an electric connector. In the electric connector 100 disclosed in the above-mentioned Patent document 1, the outer conductors 109 of plural coaxial cables 101 are caulking-connected together by means of the caulking member 111 which is a single, common connection metal plate without being soldered. With this measure, the bendability of the coaxial cables 101 is not lowered due to solder impregnation into the outer conductors 109, as a result of which the cables 101 are improved in the workability in a narrow connection space.

However, as apparatus are reduced in size, connection spaces are becoming increasingly narrower and cables are being reduced in diameter (e.g., AWG (American wire gauge) #40 to #46). In these circumstances, it is difficult to connect the center conductors, arranged at a small pitch, of a coaxial flat cable to an electric connector as disclosed in the above-mentioned Patent document 1 or the connection terminals of a substrate or the like. Furthermore, the connection using the caulking member 111 which is disclosed in Patent document 1 has a problem that the fixing strength of the cables 101 (outer conductors 109) is insufficient.

It is therefore desired to realize connectorless connection in which, for example, to minimize the number of connection positions, a connector is not used and the center conductors of respective cables are connected directly to a circuit of an apparatus.

SUMMARY OF THE INVENTION

The present invention has been made in view of the above problems, and an object of the invention is therefore to provide a coaxial cable capable of being used even in a narrow connection space and providing sufficient fixing strength even when cables are reduced in diameter, as well as its manufacturing method.

Further, another object of the invention is to provide a coaxial flat cable capable of connecting center conductors to terminals while positioning the former with respect to the latter and keeping a small-pitch-arranged state of the former, as well as its manufacturing method.

Further, still another object of the invention is to provide a coaxial cable which allows the center conductors to be connected stably and is suitably used even in a narrow connection space, as well as its manufacturing method.

To attain the above object, according to a first aspect of the invention, there is provided with a coaxial flat cable including:

plural coaxial cables arranged parallel with each other in each of which a tip portion of an outer sheath is removed and portions of an outer conductor, an insulator, and a center conductor are exposed in this order in a step-like manner;

a ground bar having lock nails for locking the coaxial cables individually fastened to the exposed portions of the outer conductors to fix a pitch of the coaxial cables, wherein the center conductors are arranged at approximately equal intervals.

According to a second aspect of the invention, there is provided with the coaxial flat cable according to the first aspect, wherein the coaxial cables are sandwiched to be fixed by a pressing member and the ground bar.

In the thus-configured coaxial cable, the pitch of the coaxial cables is fixed at a prescribed value by locking the coaxial cables individually by the lock nails of the ground bar and fastening the ground bar to the exposed portions of the outer conductors of the coaxial cables.

Since the coaxial cables are fixed by sandwiching them between the ground bar and the pressing member, the center conductors of even coaxial cables having a very small diameter can be arranged at approximately equal intervals and positioned with high accuracy.

According to a third aspect of the invention, there is provided with the coaxial flat cable according to the second aspect, wherein the ground bar comprises two rows of lock nails.

In the thus-configured coaxial cable, the coaxial cables are locked at two locations arranged in the axial direction and hence the ground bar can hold the coaxial cables firmly. Furthermore, the mechanical strength of the ground bar can be increased by forming the lock nails by bending both side portions of a band-like member approximately perpendicularly.

According to a forth aspect of the invention, there is provided with the coaxial flat cable according to the third aspect, wherein the lock nails of at least one of the two rows lock the outer conductors, and the lock nails of the other row lock the outer sheaths, the outer conductors, or the insulators.

According to the thus-configured coaxial cable, the coaxial cables can be held firmly because they are fixed at two locations arranged in the axial direction. Furthermore, since the two rows of lock nails of the ground bar are given two different widths, the deviation of each coaxial cable can be made even smaller.

According to a fifth aspect of the invention, there is provided with the coaxial flat cable according to the second aspect, wherein the coaxial cables are sandwiched between two ground bars each having lock nails for locking the coaxial cables individually to fix the pitch of the coaxial cables.

In the thus-configured coaxial cable, the pressing member is another ground bar and the coaxial cables are sandwiched between the two ground bars from above and below. Therefore, each coaxial cable is substantially grounded at two points and hence its grounding is made reliable. Furthermore, the ground potential is made stable.

According to a sixth aspect of the invention, there is provided with the coaxial flat cable according to the second aspect, wherein the pressing member is formed with one or more projection strips which extend along longer sidelines thereof.

According to the thus-configured coaxial cable, since the pressing member is formed with one or more projection strips extending perpendicularly to an axial direction of the coaxial cables (i.e., in the longitudinal direction), the projection strips serve as ribs and the strength of the pressing member can be increased. Furthermore, the projection strips make it possible to press the coaxial cables more reliably.

According to a seventh aspect of the invention, there is provided with the coaxial flat cable according to the first aspect, wherein the exposed portions of the center conductors are bonded to an insulating cover member.

In the coaxial flat cable having the above configuration, the ground bar having the lock nails capable of locking the coaxial cables individually is fastened to the exposed portions of the outer conductors, whereby the coaxial cables are positioned and fixed. Furthermore, since the exposed portions of the center conductors are bonded to the insulating cover members so as to have the prescribed pitch, the state that the exposed portions of the center conductors are arranged at the small pitch can be maintained and the center conductors can be connected to terminals while being positioned with respect to the latter with high accuracy.

According to an eighth aspect of the invention, there is provided with the coaxial flat cable according to the seventh aspect, wherein the insulating cover member are a film-like member and are formed with grooves or spacers for fixing the exposed portions of the center conductors at a prescribed pitch, and the center conductors are placed in the grooves or between the spacers.

In the coaxial flat cable having the above configuration, the center conductors can be arranged reliably at the small pitch because the exposed portions of the center conductors are placed in the grooves or between the spacers of the film-like insulating cover members and are bonded while being positioned at the prescribed pitch.

According to a ninth aspect of the invention, there is provided with the coaxial flat cable according to the seventh aspect, wherein the exposed portions of the center conductors are bonded to the insulating cover members from both side of a parallel arrangement plane of the center conductors, and at least one of the insulating cover members has a window through which parts of the exposed portions of the center conductors are accessible.

In the coaxial flat cable having the above configuration, the exposed portions of the center conductors can be fixed reliably by bonding the insulating cover members to each other with an adhesive or through melting. Furthermore, terminals can be connected to those parts of the surfaces of the center conductors which are accessible through the window of the insulating cover member. Still further, since the center conductors can be connected directly to a substrate or the like unlike in a conventional case in which the center conductors are connected to connection terminals, a connector is omitted (connector less connection is realized) and the connection portion are made simpler in structure and more compact, whereby the coaxial flat cable can be connected reliably even in a narrow connection space.

According to a tenth aspect of the invention, there is provided with the coaxial flat cable according to the ninth aspect, wherein only one of the insulating cover members has a window, and a reinforcement member is stuck to the insulating cover member not having a window.

In the coaxial flat cable having the above configuration, since the reinforcement member is stuck to the insulating cover member not having a window, the rigidity of the portion including the insulating cover members is increased. This makes it easier to establish electrical connection with a circuit by pushing the portion including the insulating cover members as it is into a receptacle of a substrate or the like.

According to an eleventh aspect of the invention, there is provided with the coaxial flat cable according to the tenth aspect, wherein the reinforcement member is interposed between the exposed portions of the center conductors and the insulating cover member, and the reinforcement member is formed with grooves or spacers for fixing the exposed portions of the center conductors at a prescribed pitch.

In the coaxial flat cable having the above configuration, the rigidity of the portion including the insulating cover members is increased because the reinforcement member is interposed between the exposed portions of the center conductors and the insulating cover member that covers the one surfaces of the exposed portions of the center conductors. This makes it easier to establish electrical connection with a circuit by pushing the portion including the insulating cover members as it is into a receptacle of a substrate or the like.

According to a twelfth aspect of the invention, there is provided with a coaxial flat cable including:

plural coaxial cables arranged parallel with each other in each of which a tip portion of an outer sheath is removed and portions of an outer conductor, an insulator, and a center conductor are exposed in this order in a step-like manner;

a ground bar having lock nails for locking the coaxial cables individually which is fastened to the exposed portions of the outer conductors to fix a pitch of the coaxial cables; wherein each of the exposed portions of the center conductors has two flat surfaces that are parallel with a parallel arrangement plane of the center conductors, both flat surfaces of each center conductor are covered with respective insulating cover members, and at least the insulating cover member adjacent to one flat surfaces has a window through which parts of the exposed portions of the center conductors are accessible.

In the coaxial cable having the above configuration, the ground bar is fastened to the exposed portions of the outer conductors of the coaxial cables by locking the coaxial cables individually by the lock nails of the ground bar, whereby the pitch of the coaxial cables can be fixed to the prescribed value. Since the positions of the exposed portions of the center conductors are restricted by the insulating cover members so that they have the prescribed pitch, the exposed portions of the center conductors can be held so as to have the prescribed pitch even during use, a transport, or the like. Since flat portions are formed in the exposed portions of the center conductors by rolling, surface contact is made when the exposed portions of the center conductors are positioned by the insulating cover member, as a result of which the insulating cover member can be bonded reliably to the one surfaces of the exposed portions of the center conductors. Furthermore, since the other surfaces, covered with the cover member in such a manner that parts of them are accessible, of the exposed portions of the center conductors are also flat, stable connections can be attained when terminals are connected to the other surfaces. Still further, since the center conductors can be connected directly to a substrate or the like unlike in a conventional case in which they are connected to connection terminals, a connector is omitted (connector less connection is realized) and the connection portion is made simpler in structure and more compact, whereby the coaxial cable can be connected reliably even in a narrow connection space.

According to a thirteenth aspect of the invention, there is provided with the coaxial flat cable according to the twelfth aspect, wherein tip portions of the center conductors are cut away to produce tip faces that are flush with each other so that the center conductors do not project from the insulating cover members.

In the thus-configured coaxial cable, the flat surfaces, exposed through the window, of the center conductors can be used for establishing electrical connection with a circuit without being obstructed by portions of the center conductors that project from the insulating cover members. The portion including the insulating cover members can be used as if it were a connector.

According to a fourteenth aspect of the invention, there is provided with the coaxial flat cable according to the twelfth aspect, wherein only the insulating cover member adjacent to the one flat surfaces has a window, and a reinforcement member is interposed between the other insulating cover member and the exposed portions of the center conductors.

In the thus-configured coaxial cable, since the reinforcement member is interposed between the insulating cover member that covers the other flat surfaces and the exposed portions of the center conductors, the rigidity of the portion including the insulating cover members is increased. This makes it easier to establish electrical connection with a circuit by pushing the portion including the insulating cover members as it is into a receptacle of a substrate or the like.

According to a fifteenth aspect of the invention, there is provided with a manufacturing method of a coaxial flat cable, including the steps of:

removing a tip portion of an outer sheath of each of plural coaxial cables and exposing portions, having prescribed lengths, of an outer conductor, an insulator, and a center conductor in this order in a step-like manner;

locking the exposed portions of at least the outer conductors by lock nails of a ground bar to position the coaxial cables at a prescribed pitch; and fastening the ground bar to the exposed portions of the outer conductors in a state that the center conductors are arranged at approximately equal intervals.

According to a sixteenth aspect of the invention, there is provided with the manufacturing method according to the fifteenth aspect, wherein the exposed portions of the outer conductors are sandwiched between the ground bar and a pressing member to fasten the exposed portions of the outer conductors to the ground bar and the pressing member in a state that the center conductors are arranged at approximately equal intervals.

This manufacturing method of a coaxial flat cable makes it possible to manufacture the coaxial cable according to the invention.

According to a seventeenth aspect of the invention, there is provided with the manufacturing method according to the fifteenth aspect, wherein the exposed portions of the center conductors are bonded to an insulating cover member.

This manufacturing method of a coaxial flat cable makes it possible to manufacture the coaxial flat cable according to the invention.

According to an eighteenth aspect of the invention, there is provided with the manufacturing method according to the seventeenth aspect, further including the step of:

flattening the exposed portions of the center conductors so that flattened surfaces are made parallel with a parallel arrangement plane of the center conductors.

In this manufacturing method of a coaxial flat cable, surface contact is made when the exposed portions of the center conductors are positioned by the insulating cover members, whereby the exposed portions of the center conductors can be bonded reliably. Surface contact is also made when the center conductors are connected to terminals, whereby stable connections can be attained.

According to a nineteenth aspect of the invention, there is provided with the manufacturing method according to the eighteenth aspect, further including the steps of:

rolling at least the exposed portions of the center conductors from both side of a parallel arrangement plane of the center conductors so as to produce flat surfaces;

covering one flat surfaces of the center conductors with an insulating cover member; and covering the other flat surfaces with an insulating cover member having a window for rendering parts of the exposed portions of the center conductors accessible.

This manufacturing method of a coaxial flat cable makes it possible to manufacture the coaxial cable according to the invention.

According to a twentieth aspect of the invention, there is provided with the manufacturing method according to the nineteenth aspect, wherein after both flat surfaces of each center conductor is covered with the insulating cover members, tip portions of the center conductors are cut away to produce tip faces that are flush with each other so that the center conductors do not project from the insulating cover members.

In this manufacturing method of a coaxial flat cable, since tip portions of the center conductors are cut away to produce tip faces that are flush with each other so that the center conductors do not project from the insulating cover members, the portion including the insulating cover members can be used as if it were a connector.

According to a twenty first aspect of the invention, there is provided with the manufacturing method according to the nineteenth aspect, wherein the one surfaces of the center conductors are covered with an insulating cover member not having a window, the other flat surfaces are covered with an insulating cover member having a window, and a reinforcement member is interposed between the exposed portions of the center conductors and the insulating cover member not having a window when the one surfaces of the center conductors are covered with the insulating cover member not having a window.

In this manufacturing method of a coaxial flat cable, electrical connection between the center conductors and a circuit can be made through the window whereas the rigidity of the portion including the insulating cover members is kept high. Therefore, it becomes easier to insert and remove the portion including the insulating cover members into and from a receptacle.

BRIEF DESCRIPTION OF THE DRAWINGS

FIG. 1(A) is a plan view of the coaxial cable and FIG. 1(B) is an end view as viewed from direction F in FIG. 1(A).

DETAILED DESCRIPTION OF THE PREFERRED EMBODIMENTS

First Embodiment

An embodiment of the present invention will be hereinafter described in detail with reference to the drawings.

Figure 1:
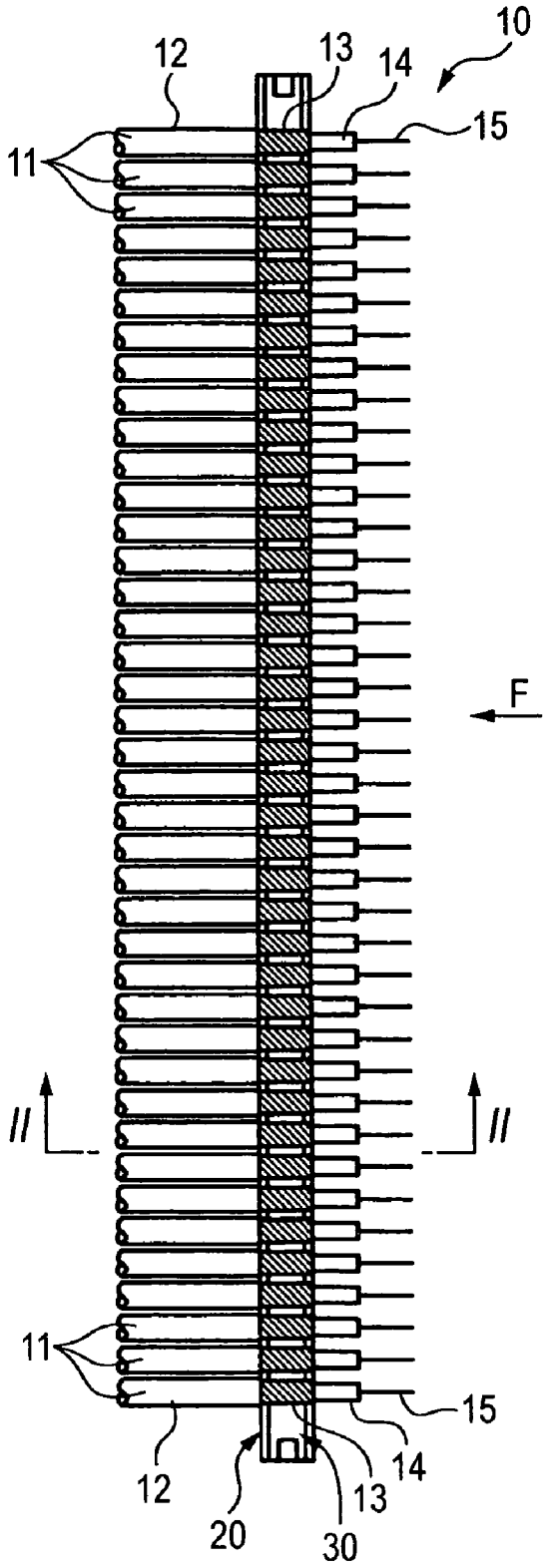
FIG. 1 shows a coaxial cable according to a first embodiment of the invention.
Figure 1:
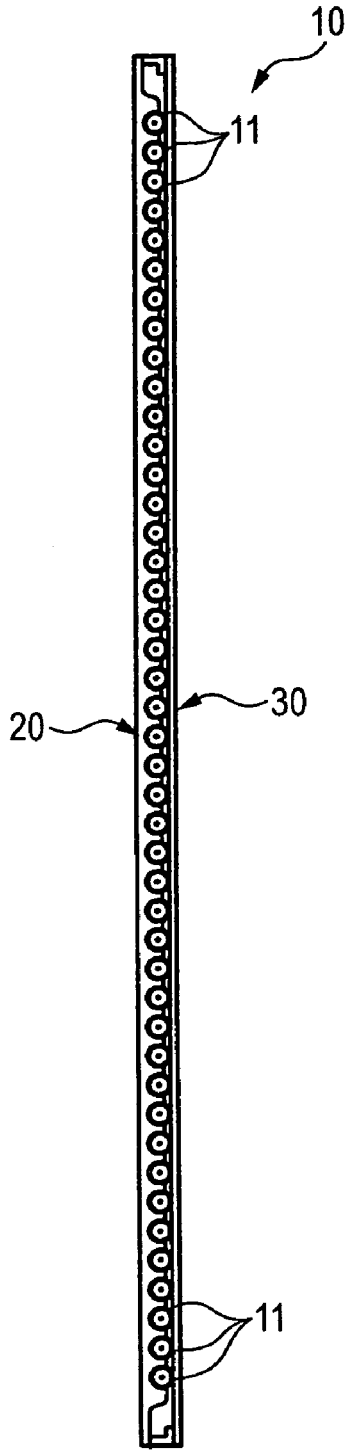
Figure 2:
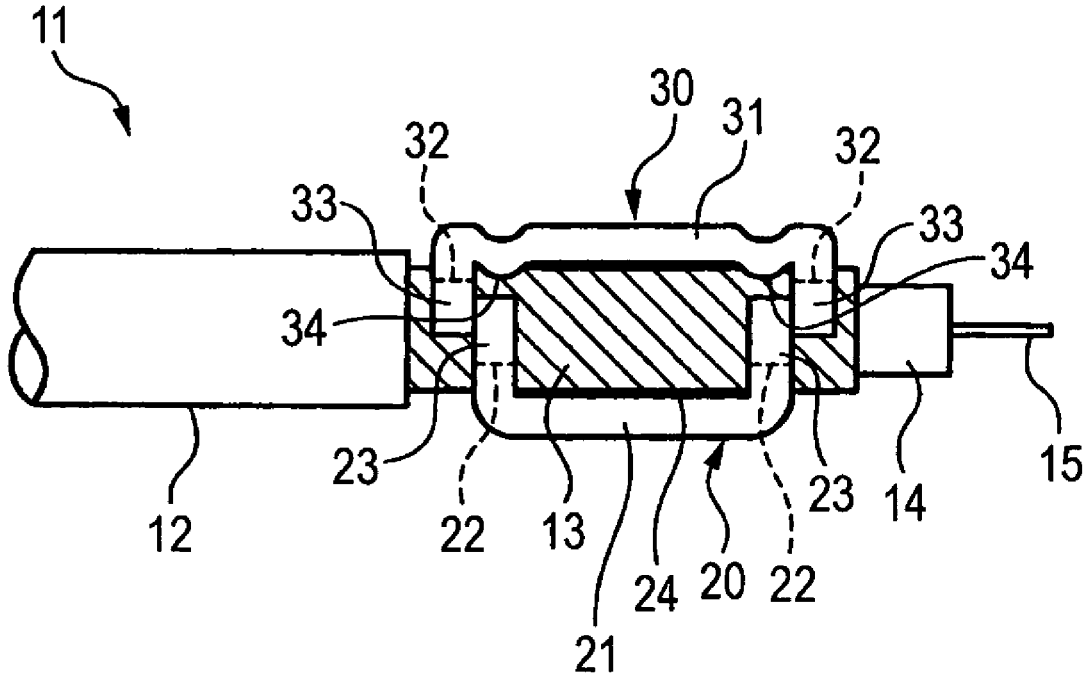
FIG. 2 is a sectional view taken along line II-II in FIG. 1(A) and showing a tip portion of a coaxial cable.
Figure 3:
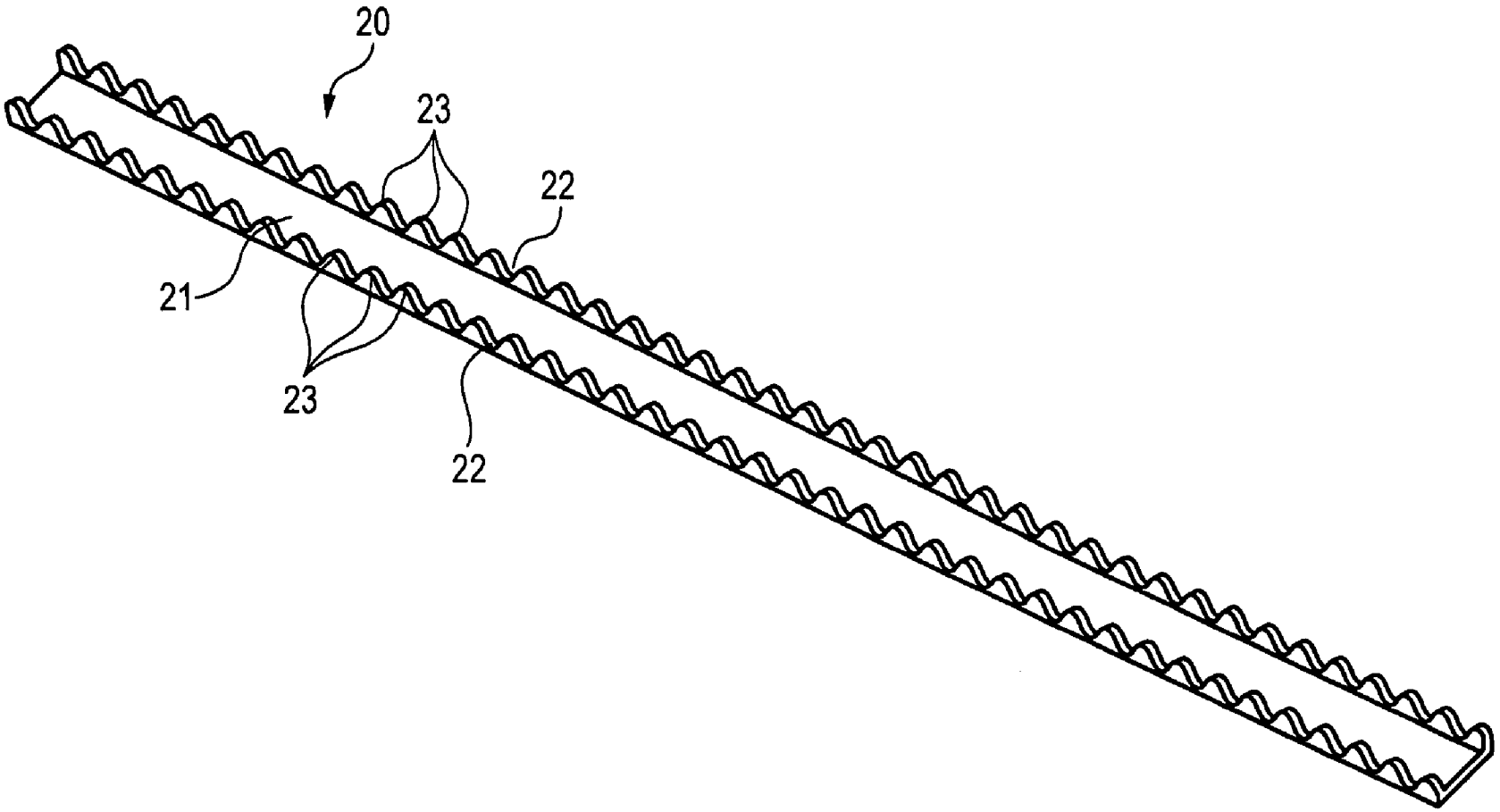
FIG. 3 is a perspective view of a ground bar excluding end portions.
Figure 4:
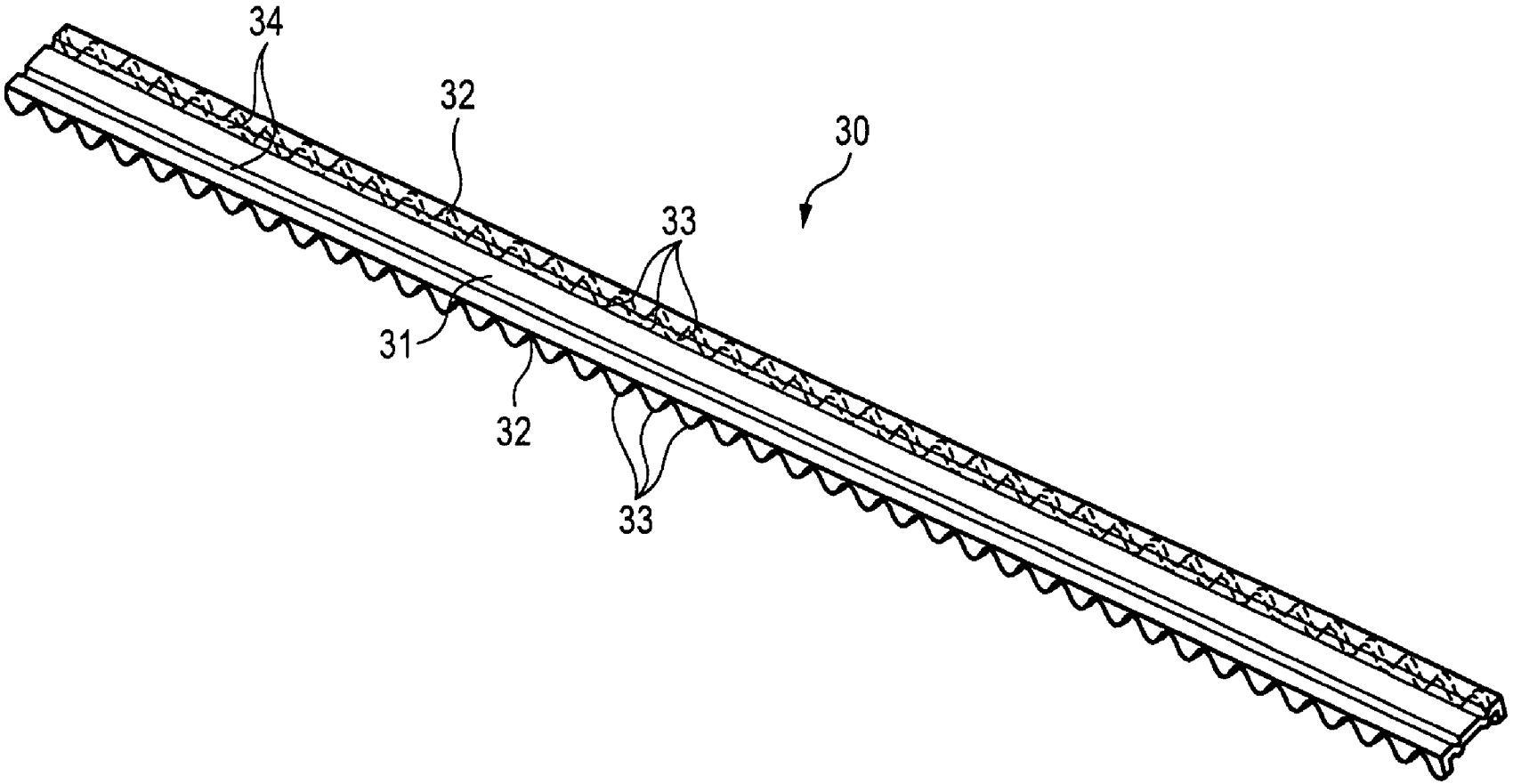
FIG. 4 is a perspective view of a pressing member excluding end portions.

FIG. 1 shows a coaxial cable according to a first embodiment of the invention. FIG. 1(A) is a plan view of the coaxial cable and FIG. 1(B) is an end view as viewed from direction F in FIG. 1(A). FIG. 2 is a sectional view taken along line II-II in FIG. 1(A) and showing a tip portion of a coaxial cable. FIG. 3 is a perspective view of a ground bar excluding end portions. FIG. 4 is a perspective view of a pressing member excluding end portions. In FIG. 1(A), the pressing member 30 (described later) is omitted to simplify the drawing.

As shown in FIG. 1, in a coaxial cable 10 according to the first embodiment of the invention, plural coaxial cables 11 are aligned in the horizontal direction. In a tip portion of each coaxial cable 11, a tip portion of an outer sheath 12 is removed and portions of an outer conductor 13, an insulator 14, and a center conductor 15 are exposed in this order in a step-like manner.

In the coaxial cable 10, as also shown in FIG. 2, a ground bar 20 which is a metal conductor is fixed to the exposed portions of the outer conductors 13 of the coaxial cables 11, whereby the outer conductors 13 are electrically connected to the ground bar 20. The ground bar 20 serves to position the coaxial cables 11 at a prescribed pitch. In the coaxial cables 11 which are positioned by means of the ground bar 20, the center conductors 15 are aligned at the prescribed pitch in a state that they project forward (rightward in FIG. 1(A)) from the ground bar 20 by a prescribed length. Since the center conductors 15 are arranged at the prescribed pitch approximately in the same plane, they function in the same manner as the connection terminals of a conventional connector.

As shown in FIG. 2, each coaxial cable 11 has the center conductor 15 at the center and the insulator 14 made of polyethylene, for example, is provided outside the center conductor 14. The outer conductor 13 formed by, for example, knitting copper wires in mesh form is provided outside the insulator 14 fully around the center conductor 15 so as to be electrically insulated from the center conductor 15. And the outer sheath 12 made of poly (vinyl chloride), for example, is provided outside the outer conductor 13. As described above, in the tip portion of each coaxial cable 11, the portions, having prescribed lengths, of the center conductor 15, the insulator 14, and the outer conductor 13 are exposed in this order from the tip in a step-like manner.

As shown in FIG. 3, the ground bar 20 is formed by bending both side portions of a band-like member (metal conductor) approximately perpendicularly along the longitudinal direction, whereby the ground bar 20 is formed by a plane portion 21 and vertical walls 22 and assumes a bracket shape in cross section. Each of the two vertical walls 22 is formed with many lock nails 23 which are arranged at a prescribed pitch. Each coaxial cable 11 is inserted in a groove between adjoining lock nails 23. The pitch of the lock nails 23 is the arrangement pitch of the coaxial cables 11. The width of each groove is set equal to the outer diameter of each outer conductor 13. The coaxial cables 11 are inserted between the lock nails 23 at the prescribed pitch and are thereby arranged at the prescribed pitch.

Since both vertical walls 22 are formed with the lock nails 23, each coaxial cable 11 can be positioned being restricted at two locations arranged along its axial direction (in the right-left direction in FIG. 2) and hence can be held firmly and locked reliably.

Having the bracket-shaped cross section, the ground bar 20 is given high mechanical strength. Another structure is possible that the vertical walls 22 are not formed and lock nails 23 (lock portions) are formed by bending them so as to erect directly from the plane portion 21.

Returning to FIG. 2, the lock nails 23, located at least on one side, of the ground bar 20 lock the outer conductors 13 and the lock nails 23 located on the other side lock the outer conductors 13, the outer sheaths 12, or the insulators 14. For example, in the example of FIG. 2, the lock nails 23 located on both sides lock the outer conductors 13. Locking the outer conductors 13 by means of the lock nails 23 of at least one of the two rows makes it possible to ground the outer conductors 13 together to the ground bar 20.

A joining member 24 is provided between the ground bar 20 and the outer conductor 13, and the coaxial cables 11 are joined and fixed to the ground bar 20 by the joining member 24.

The joining member 24 may be a solder plate, for example. Other examples of the joining member 24 are an anisotropic conductive film (ACF) and a conductive adhesive (paste). The joining member 24 fastens and electrically connects the outer conductors 13 to the ground bar 20.

In this embodiment, a pressing member 30 is provided to sandwich the coaxial cables 11 between itself and the ground bar 20.

As shown in FIG. 4, like the ground bar 20, the pressing member 30 is formed by bending both side portions of a band-like member (metal conductor) approximately perpendicularly along the longitudinal direction, whereby the ground bar 20 is formed by a plane portion 31 and vertical walls 32 and assumes a bracket shape in cross section. Each vertical wall 32 is formed with lock nails 33 at a prescribed width and pitch so that they correspond to the respective lock nails 23 of the ground bar 20 and allow the coaxial cables 11 to be inserted individually between the lock nails 33.

As also shown in FIG. 2, the pressing member 30 is formed with two projection strips 34 which project inward from the plane portion 31 and extend along the longitudinal direction. The projection strips 34 can not only press the outer conductors 13 of the coaxial cables 11 strongly against the ground bar 20 but also increase the mechanical strength of the pressing member 30 because they serve as ribs.

It is effective that the projection strips 34 are located at such positions as to be opposed to the lock nails 23 (i.e., vertical walls 22) of the ground bar 20. It is desirable to form two projection strips 34 in the above-described manner, in which case the projection strips 34 can prevent the pressing member 30 from warping. Alternatively, the ground bar 20 may be formed with similar projection strips.

Since the coaxial cables 11 that are positioned by the ground bar 20 are sandwiched and pressed from the side opposite to the ground bar 20, the coaxial cables 11 can be fixed strongly by the ground bar 20 and the pressing member 30.

In general, the center conductor 15 is preferably a stranded copper wire because it is flexible and resistant to bending. However, being prone to suck up solder, the stranded wire may suck up solder to the insulator 14 when the center conductor 15 is soldered to a substrate or the like. The insulator 14 may be hardened to lower the bendability of the coaxial cable 11. In view of this, it is preferable to employ very thin coaxial cable 11 (AWG #44 or #46). Where sucking-up of solder should be avoided, it is preferable to use a single-wire center conductor 15. A single wire is free of the problem of sucking-up of solder and has an advantage that the arrangement pitch is not prone to vary, though it has high rigidity and hence is hard to bend.

The above coaxial cable 10 enables connectorless connection (a conventional electric connector having connection terminals is omitted), and thereby makes the connection portion simpler in structure and more compact. As such, the coaxial cable 10 can be used in even a narrow connection space.

Although in the above embodiment the ground bar 20 and the pressing member 30 are separate members, the pressing member 30 may be a ground bar. That is, the coaxial cables 11 may be sandwiched between the two ground bars.

Next, a manufacturing method of the coaxial cable 10 according to the invention will be described.

Figure 5:
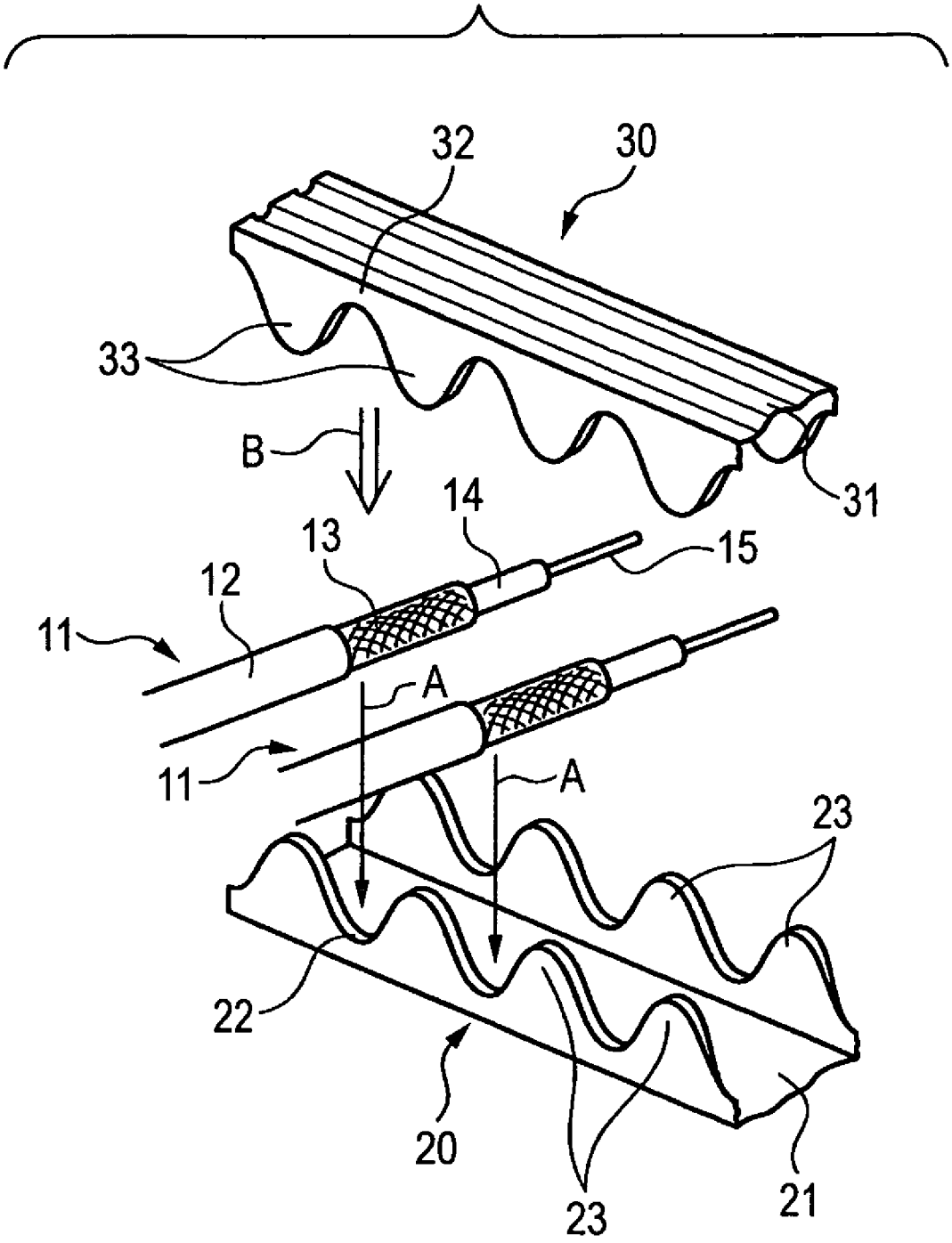
FIG. 5 is an exploded perspective view showing a manufacturing method of the coaxial cable according to the invention.

As shown in FIG. 5, in the manufacturing method of the coaxial cable 10, first, plural coaxial cables 11 are set parallel with each other, slits are formed in their outer sheaths 12 by laser burning, and tip portions of the sheaths 12 are removed simultaneously. Likewise, slits are formed in the outer conductors 13 and the insulators 14 by laser burning, and their tip portions are removed simultaneously, whereby portions, having prescribed lengths, of the outer conductor 13, the insulator 14, and the center conductor 15 of each coaxial cable 11 are exposed in this order in a step-like manner. Then, the exposed portions of at least the outer conductors 13 are inserted between the lock nails 23 of a ground bar 20 and positioned at a prescribed pitch (indicated by arrows A in FIG. 5). At the same time, a pressing member 30 is applied from above (indicated by arrow B in FIG. 5) and the ground bar 20 and the pressing member 30 are fastened to the coaxial cables 11 with solder, a conductive adhesive, or the like in a state that the center conductors 15 of the coaxial cables 11 project forward from the ground bar 20 and the pressing member 30.

The outer conductors 13 are joined to the ground bar 20 and the pressing member 30 by heating and melting solder plates that are interposed between the outer conductors 13 and the plane portions 21 and 31 of the ground bar 20 and the pressing member 30. Where anisotropic conductive films (ACFs), conductive adhesives (paste), or the like are used instead of solder plates, influence of heat that is generated by heating can be avoided.

According to the above-described manufacturing method of the coaxial cable 10, the coaxial cable 10 can be connected and fixed to another circuit or the like in a state that the center conductors 15 of the coaxial cable 11 are arranged at prescribed pitch and their tip portions are aligned. Therefore, the center conductors 15 need not be connected to connection terminals and the coaxial cable 10 can be connected directly to interconnections on a substrate or the like (a conventional electric connector can be omitted). As such, the coaxial cable 10 makes the connection portion more compact and hence can be used in a narrow connection space.

The coaxial cable and its manufacturing method according to the invention are not limited to those according to the above embodiment and modifications, improvements, etc. can be made as appropriate.

Figure 6:
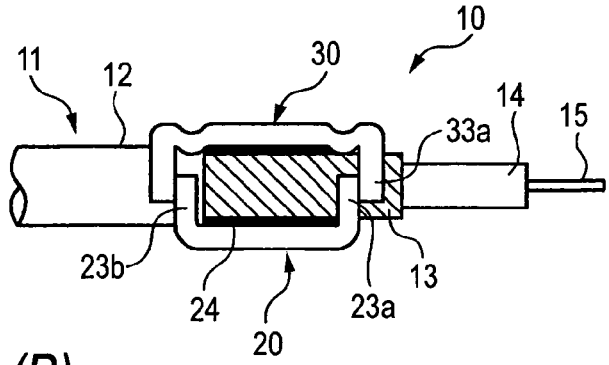
FIG. 6(A) is a sectional view showing a structure that lock nails, located on one side, of the ground bar lock outer conductors and lock nails located on the other side lock outer sheaths.
FIG. 6(B) is a sectional view showing a structure that lock nails, located on one side, of the ground bar lock insulators and lock nails located on the other side lock outer conductors.
Figure 6:
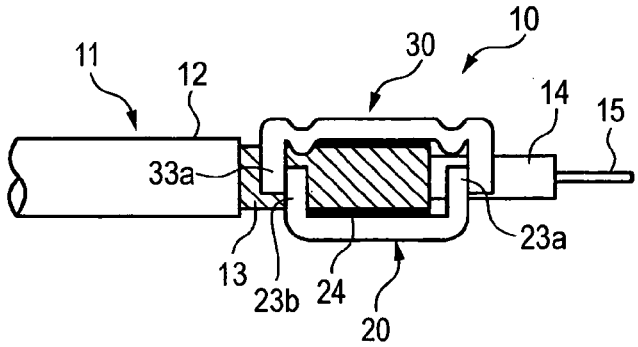

Examples will be described below. The above embodiment is directed to the case that, as shown in FIG. 2, the lock nails 23, located on both sides, of the ground bar 20 lock the outer conductors 13 at two locations in the axial direction of the coaxial cables 11. However, satisfactory results are obtained as long the lock nails 23, located at least on one side, lock the outer conductors 13. That is, as shown in FIG. 6(A), another configuration is possible in which lock nails 23*a* located on one side lock the outer conductors 13 and lock nails 23*b* located on the other side lock the outer sheaths 12. As shown in FIG. 6(B), still another configuration is possible in which lock nails 23*a* located on one side lock the insulators 14 and lock nails 23*b* located on the other side lock the outer conductors 13. Since the width of the lock nails 23*a* (lock portions) located on one side is different from that of the lock nails 23*b* (lock portions) located on the other side, movement of each coaxial cable 11 in the arrangement direction is suppressed and hence the deviation of each center conductor 15 in the arrangement direction can be made even smaller. Likewise, at least the lock nails 33, located on one side, of the pressing member 30 lock the outer conductors 13.

Figure 7:
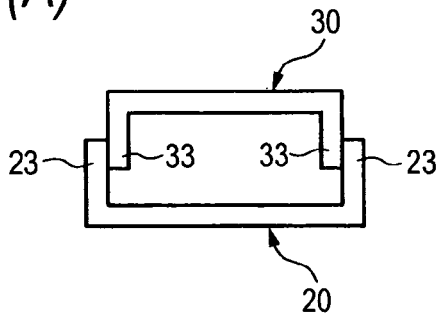
FIGS. 7(A) and 7(B) are sectional views showing other examples of the relationships between the ground bar and the pressing member.
Figure 7:
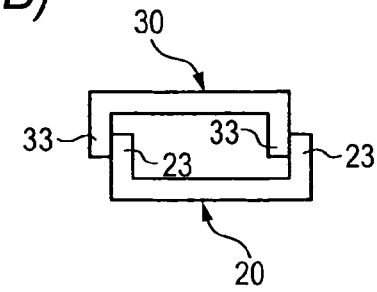

In the above embodiment, as shown in FIG. 2, the width of the pressing member 30 is greater than that of the ground bar 20 and the pressing member 30 is provided so as to surround the ground bar 20. Another structure shown in FIG. 7(A) is possible in which the width of the ground bar 20 is made greater than that of the pressing member 30 and the ground bar 30 is provided so as to surround the pressing member 30. Still another structure shown in FIG. 7(B) is possible in which the width of the pressing member 30 is made approximately the same as that of the ground bar 20 and they are combined in such a manner that their vertical walls 22 and 32 are disposed alternately.

Figure 8:
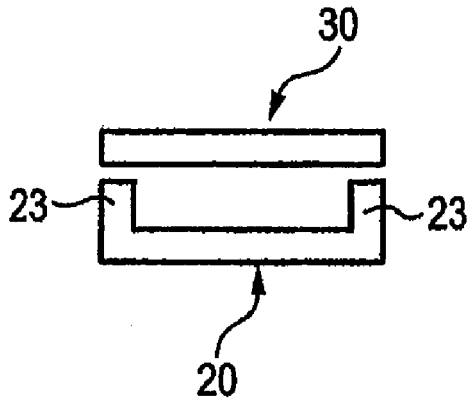
FIG. 8 is a sectional view of a pressing member which is a flat plate.
Figure 9:
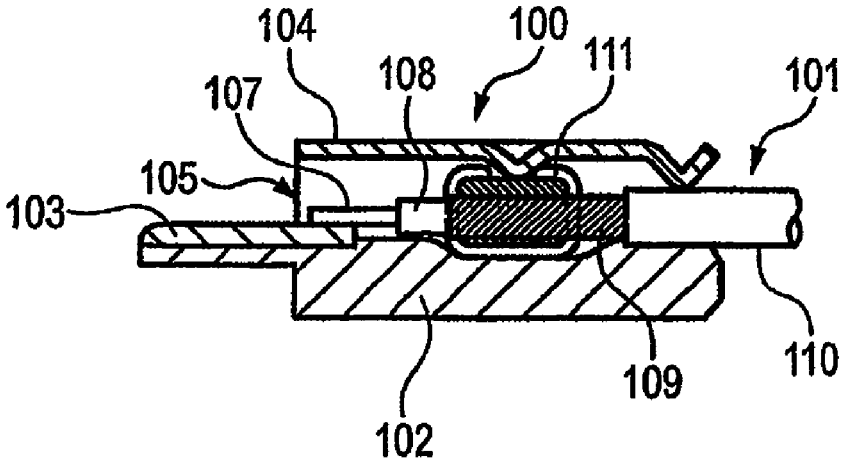
FIG. 9 is a sectional view showing a conventional electric connector.

In the above embodiment, as shown in FIGS. 2 and 4, the pressing member 30 has the vertical walls 32 and the lock nails 33 in the same manner as the ground bar 20 does. However, as shown in FIG. 8, the pressing member 30 may be a simple flat plate (i.e., it is not formed with the vertical walls 32 or the lock nails 33).

Second Embodiment

Figure 10:
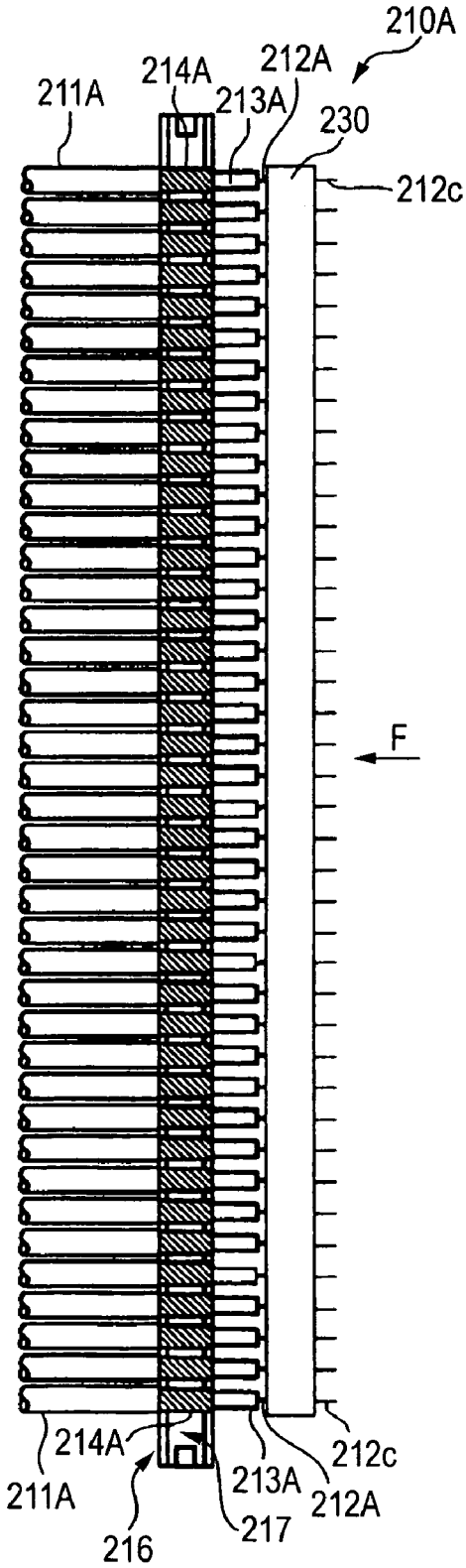
FIG. 10(A) is a plan view of a coaxial flat cable according to a second embodiment of the present invention.
FIG. 10(B) is an end view as viewed from direction F in FIG. 10(A).
Figure 10:
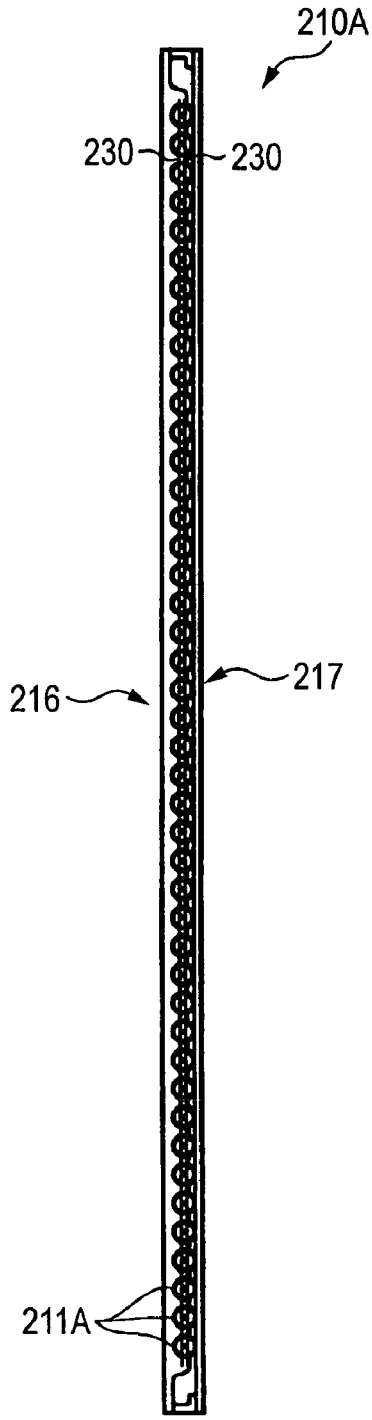
Figure 11:
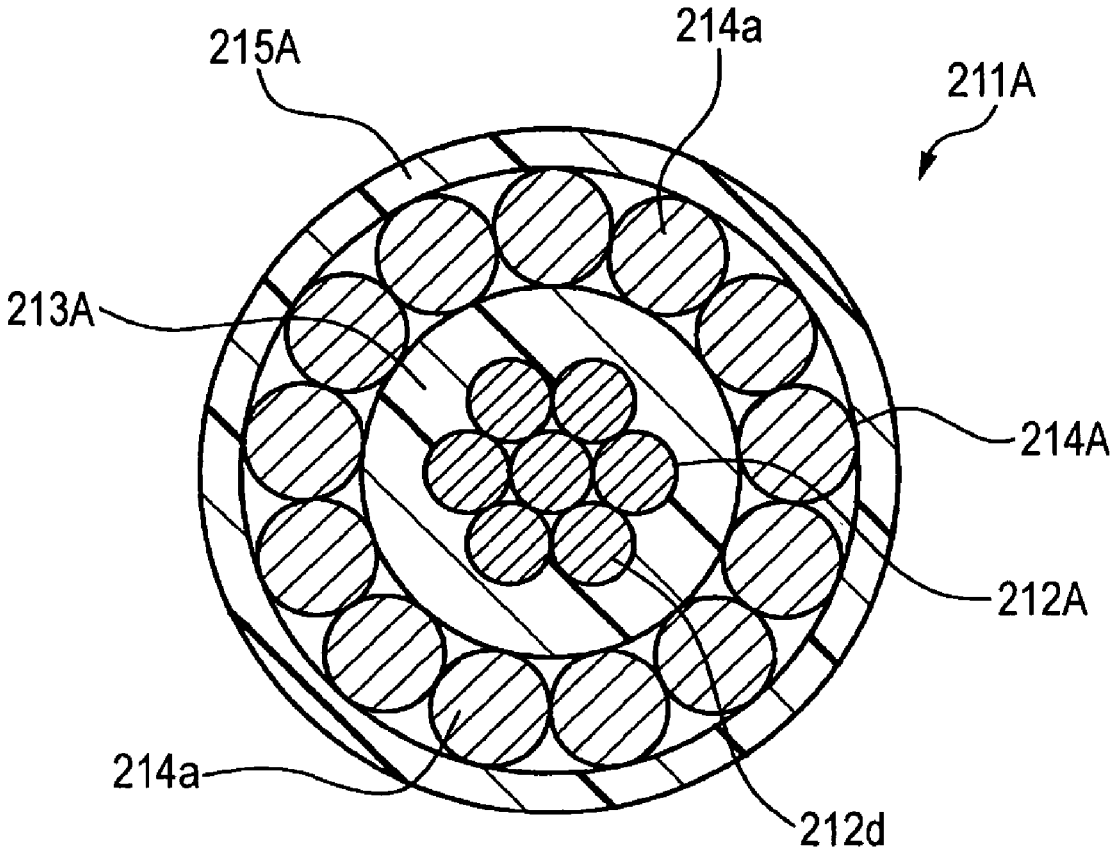
FIG. 11 is a sectional view of an exemplary coaxial cable.

FIG. 10(A) is a plan view of a coaxial flat cable according to a second embodiment of the invention and FIG. 10(B) is an end view as viewed from direction F in FIG. 10(A). FIG. 11 is a sectional view of an exemplary coaxial cable. FIGS. 12(A) and 12(B) are sectional views of insulating cover members having grooves and spacers, respectively. FIG. 13 is a plan view showing a state that the tip portions of center conductors are connected to terminals.

As shown in FIGS. 10(A) and 10(B), in a coaxial flat cable 210A according to the second embodiment of the invention, plural coaxial cables 211A are arranged parallel with each other. Their end portions have been subjected to inner members exposing treatment; that is, portions, having prescribed lengths, of a center conductor 212A, an inner insulator 213A, and an outer conductor 214A of each coaxial cable 211A are exposed in this order from the tip side in a step-like manner.

The exposed portions of the outer conductors 214A of the coaxial cables 211A are locked individually by a ground bar 216, whereby the parallel arrangement pitch of the coaxial cables 211A is fixed. The exposed portions of the center conductors 212A are bonded to an insulating cover member 230 in a state that they are arranged parallel with each other at the prescribed pitch, and tip portions 212*c* of the center conductors 212A project forward (rightward in FIG. 10(A)) from the insulating cover member 230 by a prescribed length.

As shown in FIG. 11, each coaxial cable 211A has the center conductor 212A, the insulator (inner insulator) 213A disposed around the center conductor 212A, the outer conductor 214A disposed around the insulator 213A, and an insulative outer sheath 215A disposed around the outer conductor 214A, all of which are arranged concentrically.

For example, the coaxial cable 211A is a cable of AWG (American wire gauge (standard)) #42. In the coaxial cable 211A of AWG #42, for example, the center conductor 212A is formed by twisting seven strands 212*d* made of a silver-plated copper alloy and having an outer diameter 0.025 mm and is 0.075 mm in outer diameter. The insulator 213A, which covers the outer circumferential surface of the center conductor 212A, is made of a fluororesin such as PFA, for example, and is formed by extrusion coating so as to have an outer diameter 0.165 mm. The outer conductor 214A is formed by winding a strand 214*a* having an outer diameter 0.03 mm and made of a tin-plated copper alloy, for example, on the outer circumferential surface of the insulator 213A in a spiral manner by horizontal winding so as to have an outer diameter 0.225 mm. The outer sheath 215A, which covers the outer circumferential surface of the outer conductor 214A, is made of a fluororesin such as PFA and is 0.29 mm in outer diameter in the case of AWG #42.

The center conductor 212A is not limited to a stranded wire and may be a single wire.

A pressing member 217 is opposed to the ground bar 216. The exposed portions of the outer conductors 214A are sandwiched between the pressing member 217 and the ground bar 216, whereby the coaxial cables 211A are held reliably. The pressing member 217 may have the same structure as the ground bar 216. That is, the exposed portions of the outer conductors 214A may be sandwiched between two ground bars. The pressing member 217 may be a plate having no lock nails.

The insulating cover member 230 is a film-like member and may be formed by applying a thermosetting epoxy resin as an adhesive to the surface of a heat-resistant resin such as polyimide. Although the insulating cover member 230 may be a simple flat film, it is preferable that as shown in FIG. 12(A) the insulating cover member 230 have grooves 231 for fixing the exposed portions of the center conductors 212A at the prescribed pitch. The grooves may be circular-arc-shaped recesses or V-shaped grooves formed in the surface of the insulating cover member 230. Alternatively, as shown in FIG. 12(B), positioning spacers 232 may be formed on the surface of the insulating cover member 230 at the same pitch as the pitch of the center conductors 212A. An adhesive (e.g., PVC, polyester, or polyolefin) may be used in bonding the exposed portions of the center conductors 212A to the insulating cover member 230. In this manner, the exposed portions of the center conductors 212A that are placed in the grooves 231 or between the spacers 232 of the insulating cover member 230 can be fixed reliably at the small pitch. The spacers 232 may be formed so as to be integral with the insulating cover member 230 in forming the insulating cover member 230. A film or the like may be stuck to the insulating cover member 230. Where the positioning spacers 232 are linear ones, grooves are formed between them. The positioning spacers 232 may be dotted ones or pole-shaped ones.

The insulating cover members 230 may be stuck to the exposed portions of the center conductors 212A from both sides of their parallel arrangement plane (see FIG. 10(B)). In this case, the exposed portions of the center conductors 212A can be fixed more reliably by bonding the insulating cover members 230 to each other with an adhesive or through melting. The parallel-arranged state of the exposed portions of the center conductors 212A is kept stable as long as at least one of the insulating cover members 230 is formed with the grooves 231 or the spacers 232. Although it is sufficient for the insulating cover members 230 to fix only the exposed portions of the center conductors 212A, the insulating cover members 230 may such as to also cover parts of the exposed portions of the insulators 213A.

Where the insulating cover members 230 are attached from both sides, one of them may be a reinforcement member made of a heat-resistant resin (e.g., heat-resistant polyester). Where the reinforcement member is stuck, the reinforcement member resists the pressing force on the center conductors 212A when terminals are pressed against the center conductors 212A, whereby the electrical connections between the center conductors 212A and the terminals can be made reliable. In a connection method in which the portion including the insulating cover members 230 is inserted into and removed from a receptacle, the center conductors 212A can be inserted and removed without being bent or damaged. As such, the portion including the insulating cover members 230 can be used like a connector.

Figure 12:
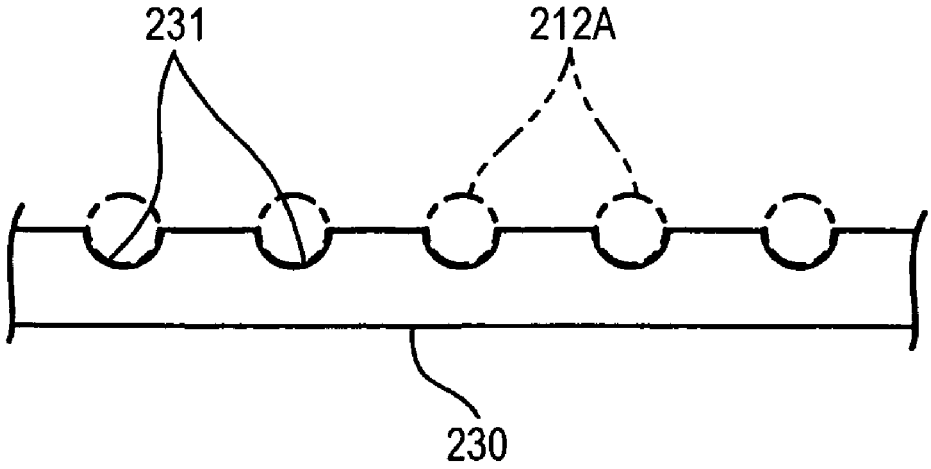
FIGS. 12(A) and 12(B) are sectional views of insulating cover members having grooves and spacers, respectively.
Figure 12:
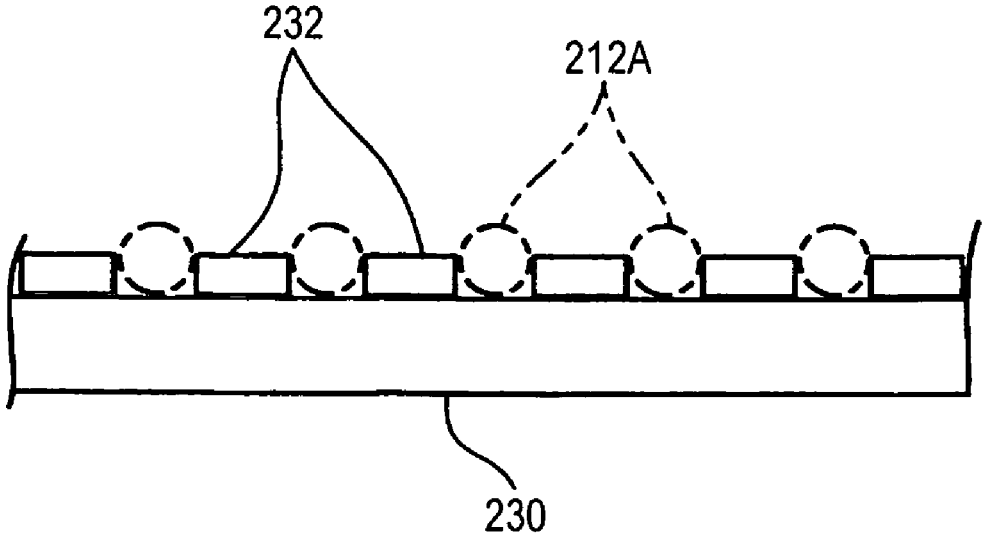
Figure 13:
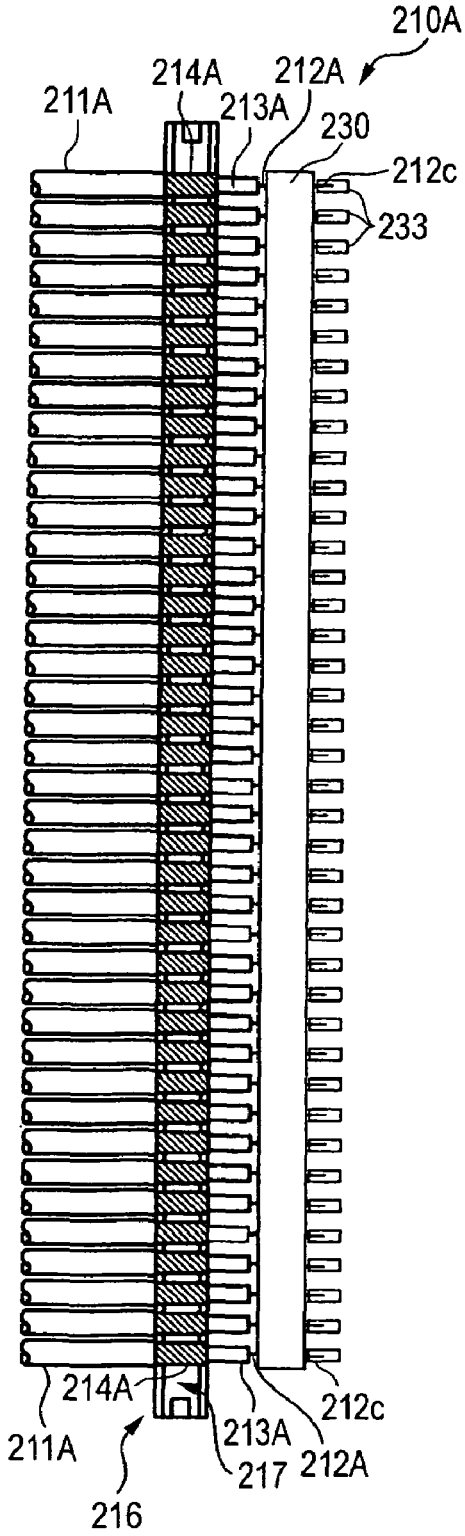
FIG. 13 is a plan view showing a state that the tip portions of center conductors are connected to terminals.

It is preferable that the reinforcement member be also formed with grooves 231 or spacers 232 as shown in FIG. 12. The exposed portions of the center conductors 212A are arranged properly by the grooves 231 or the spacers 232. The grooves 231 can be formed in the reinforcement member more easily when it is thicker than the insulating cover member 230.

A reinforcement member may be added beneath the insulating cover member 230 (i.e., stuck to the opposite surface of the insulating cover member 230 to the center conductors 212A). The center conductors 212A, the insulating cover member 230, and the reinforcement member are laid one on another in this order. In this case, it is not necessary to form grooves 231 or spacers 232 in or on the reinforcement member. Even if located beneath the insulating cover member 230, the reinforcement member likewise provides the advantage that the exposed portions of the center conductors 212A are not bent or damaged when the portion including the insulating cover member 230 is inserted into or removed from a receptacle.

Instead of using the film-like insulating cover member 230, an insulative resin may be applied to the exposed portions of the center conductors 212A and then solidified so that of the exposed portions of the center conductors 212A have the prescribed pitch. Another method is possible that the exposed portions of the center conductors 212A are put into a die and an insulative resin is poured into the die and thereby shaped. Still another method is possible that a window 221*a* (see FIG. 14; described later) is formed in at least one of the insulating cover member 230 so that connections can be made from above and/or below.

In the above-described coaxial flat cable 210A, the plural coaxial cables 211A are positioned and fixed by fastening, to the exposed portions of the outer conductors 214A of the coaxial cables 211A, the ground bar 216 having the lock nails 223 capable of locking the coaxial cables 211A individually and the exposed portions, arranged at the prescribed pitch, of the center conductors 212A are bonded to the insulating cover member 230. Therefore, the state that the exposed portions of the center conductors 212A are arranged at the small pitch can be maintained and the center conductors 212A can be connected to terminals while being positioned with respect to the latter with high accuracy. With this structure, as shown in FIG. 13, the tip portions 212*c*, projecting from the insulating cover member 230, of the plural center conductors 212A can easily be connected to respective terminals 233 of a counterpart connector, substrate, or the like by connector connection or soldering.

Third Embodiment

Next, a coaxial flat cable and its manufacturing method according to a third embodiment of the invention will be described.

Figure 14:
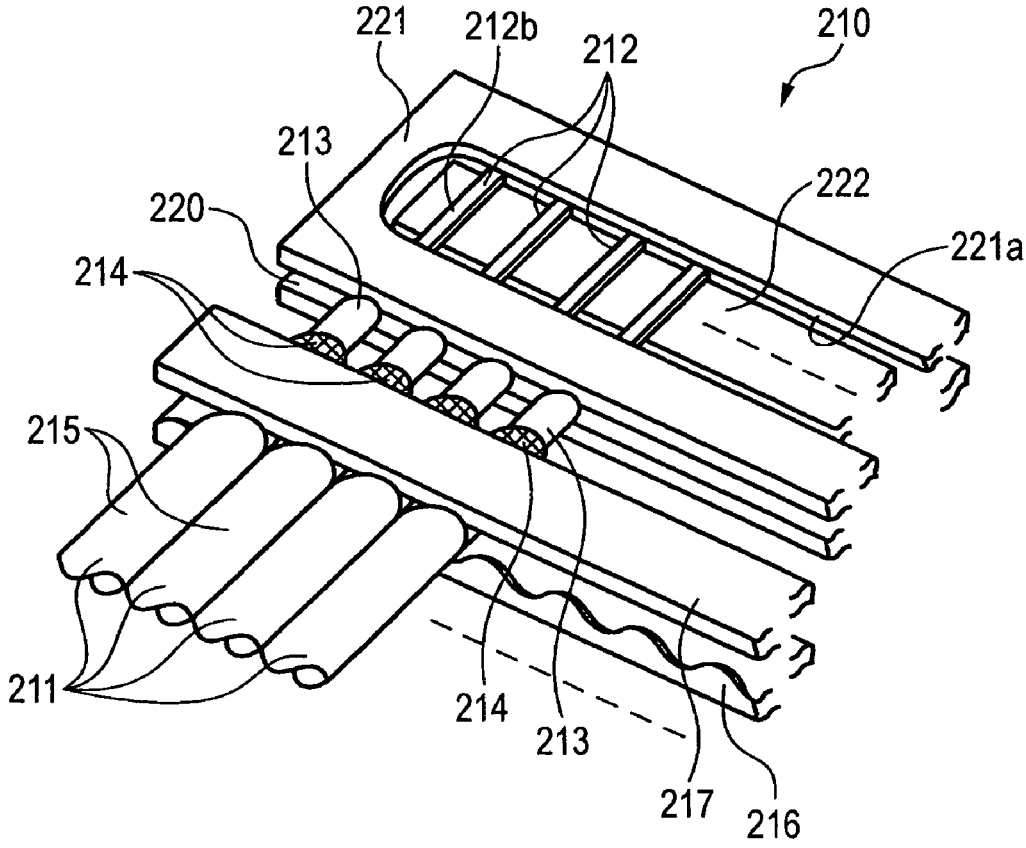
FIG. 14 is a perspective view of a coaxial flat cable according to a third embodiment of the invention.

FIG. 14 is a perspective view of a coaxial flat cable according to the third embodiment of the invention. FIG. 15(A) is a plan view of the coaxial flat cable, and FIG. 15(B) is a sectional view taken along line B-B in FIG. 15(A). FIGS. 16(A)-16(C) are plan views and sectional views as process diagrams showing a manufacturing method of a coaxial flat cable according to the third embodiment of the invention.

Figure 15:
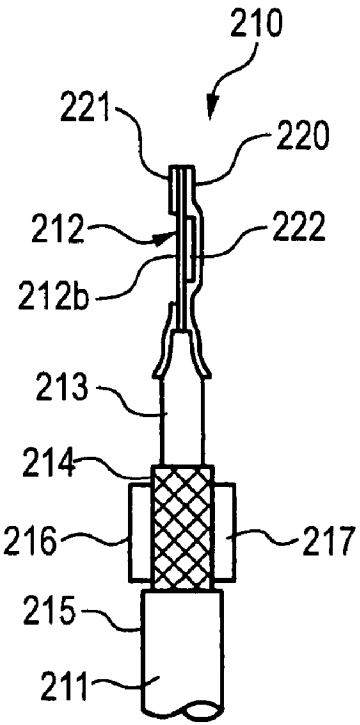
FIG. 15(A) is a plan view of the coaxial flat cable.
FIG. 15(B) is a sectional view taken along line B-B in FIG. 15(A).
Figure 15:
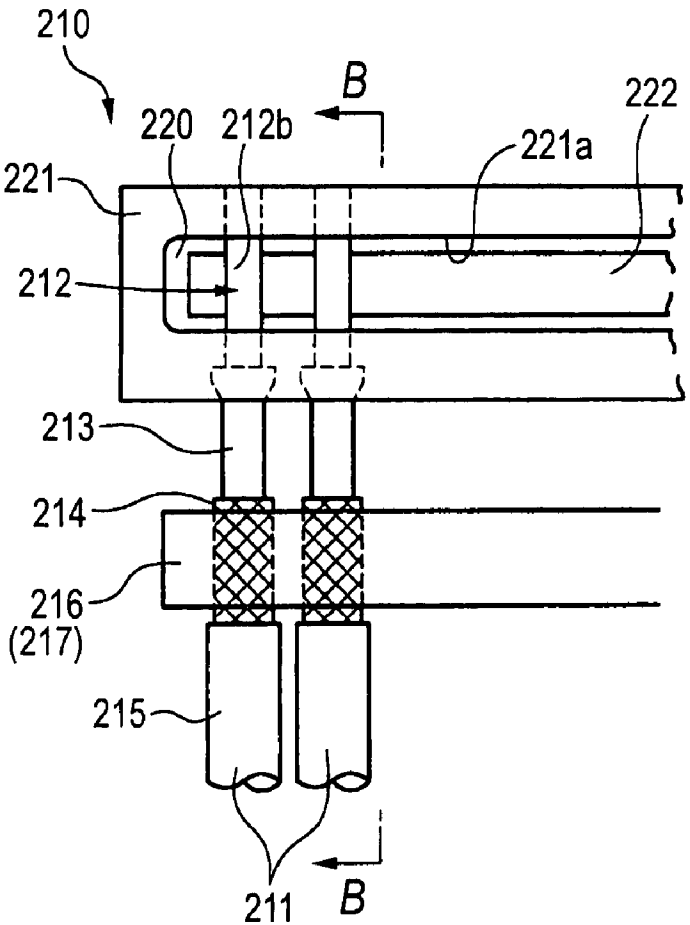
Figure 16:
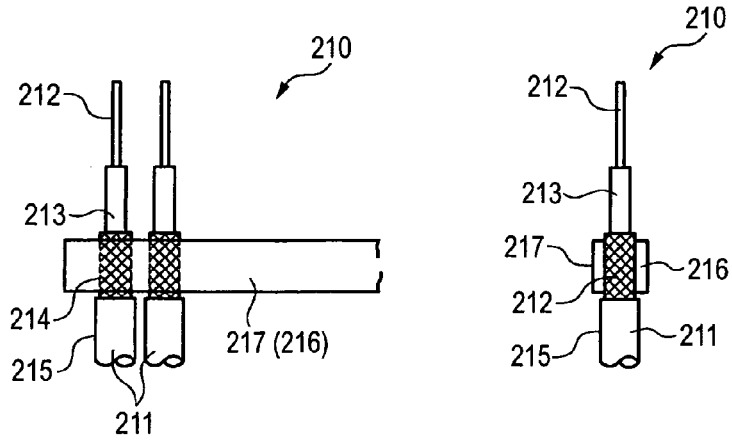
FIGS. 16(A)-16(C) are process diagrams showing a manufacturing method of a coaxial flat cable according to the third embodiment of the invention.
Figure 16:
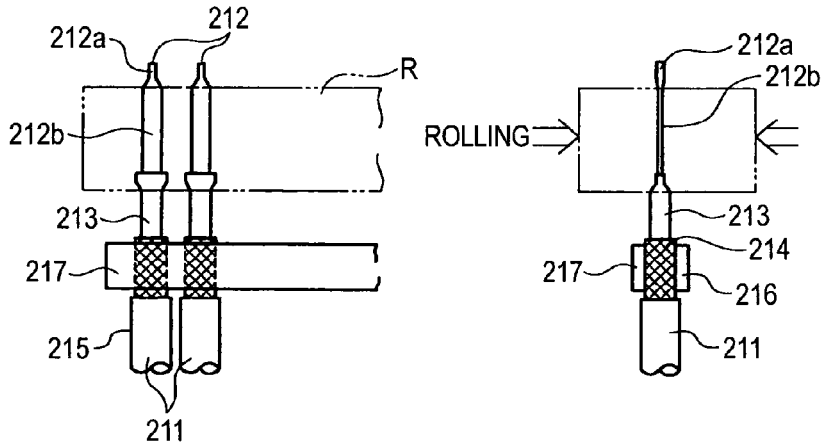
Figure 16:
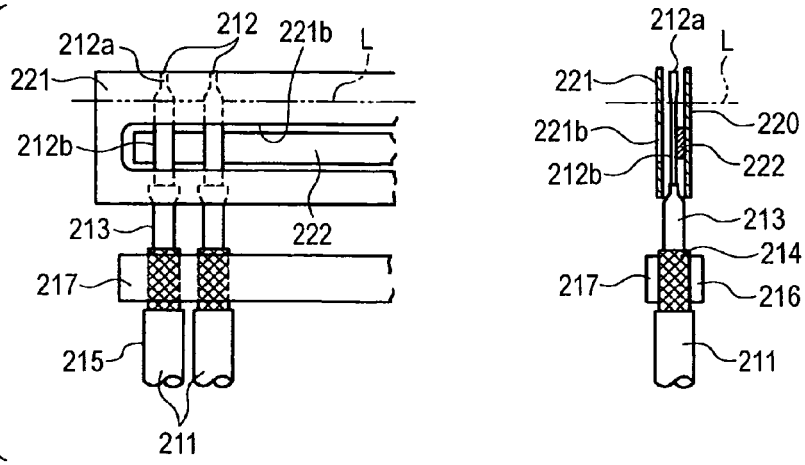

As shown in FIGS. 14 and 15, in a coaxial flat cable 210 according to the third embodiment of the invention, in a tip portion of each of plural coaxial cables 211 which are arranged parallel with each other, portions of a center conductor 212, an insulator 213, and an outer conductor 214 are exposed from an outer sheath 215 in this order in a step-like manner. Aground bar 216 is provided which is engaged with the tip portions of the coaxial cables 211 and thereby positions the coaxial cables 211 at a prescribed pitch and which is fastened to the outer conductors 214.

At least the exposed portions of the center conductors 212 are flat. The flat surfaces of the center conductors 212 are approximately parallel with the parallel arrangement plane of the coaxial cables 211; that is, the two flat surfaces of each center conductor 212 are parallel with each other. A first cover member 220 as an insulating cover member for restricting the positions of the exposed portions of the center conductors 212 so that they are given a prescribed pitch is attached to one flat surfaces of the center conductors 212, and a second cover member 221 as an insulating cover member for rendering at least parts of the exposed portions of the center conductors 212 accessible is attached to the other flat surfaces of the center conductors 212.

The coaxial cables 211 are very small diameter cables (AWG (American wire gauge) #40 to #46). As shown in FIG. 15, each coaxial cable 211 has the center conductor 212 at the center. In general, a stranded copper cable is preferably used as a center conductor because it is flexible and resistant to bending. However, in this embodiment, each center conductor 212 is a single wire which is hard to deform. The center conductors 212 are flattened. It is desirable that short tip portions of the insulators 213 be also flattened.

The ground bar 216 is configured in the same manner as in the second embodiment. The exposed portions of the outer conductors 214 are sandwiched between the ground bar 216 and a pressing member 217 which is opposed to the ground bar 216, whereby the coaxial cables 211A are held reliably.

Each of the first cover member 220 and the second cover member 221 which fix the center conductors 212 from below and above, respectively, may be a cover member formed by applying an epoxy resin (adhesive) to the surface of a thermosetting resin member made of polyimide or the like. Therefore, although the first cover member 220 is bonded to the exposed portions of the center conductors 212 from below, the first cover member 220 can reliably be bonded to the exposed portions of the center conductors 212 and hold them so that they are given the prescribed pitch because the exposed portions of the center conductors 212 are flat. Furthermore, when the second cover member 221 is placed over the first cover member 220 so that the exposed portions of the center conductors 212 are sandwiched between them from above and below, the epoxy resin layers applied to the first cover member 220 and the second cover member 221 are joined to each other, whereby the exposed portions of the center conductors 212 are held reliably. Since a central portion of the second cover member 221 is cut to form a window 221*a*, parts of the exposed portions of all the center conductors 212 are accessible as shown in FIG. 15(A).

It is desirable that a reinforcement member 222 be interposed between the one flat surfaces (located on the right side in FIG. 15(B)) of the exposed portions of the center conductors 212 and the first cover member 220 (not having a window) which is attached to the one flat surfaces. The reinforcement member 222 reinforces the flat portions 212*b* of the center conductors 212 from below and is made of a heat resistant resin (e.g., heat resistant polyester). The reinforcement member 222 is long enough to be comparable with the entire width (in the right-left direction in FIG. 15(A)) of the coaxial flat cable 210 and wide enough to cover most of the portion, rendered accessible by the window 221*a* of the second cover member 221, of each center conductor 212. With this structure, the portions, sandwiched between the insulating cover members 220 and 221, of the center conductors 212 can be increased in rigidity. Furthermore, the reinforcement member 222 resists the pressing force when terminals are pressed against the flat portions 212*b* of the center conductors 212A, whereby the electrical connections between the center conductors 212 and the terminals can be made reliable. In a connection method in which the portion including the insulating cover members 220 and 221 is inserted into and removed from a receptacle, the exposed portions of the center conductors 212 can be inserted and removed without being bent or damaged. As such, the portion including the insulating cover members 220 and 221 can be used like a connector. It is preferable that the reinforcement member 222 be formed with grooves or spacers (see FIG. 12) for arranging the exposed portions of the center conductors 212 properly at the prescribed pitch. In this case, the first cover member 220 need not be formed with grooves or spacers. The reinforcement member 222 may be stuck to the bottom surface of the first cover member 220 in such a manner that the center conductors 212, the first cover member 220, and the reinforcement member 222 are arranged in this order. In this case, it is preferable that the first cover member 220 be formed with grooves or spacers. And the reinforcement member 222 need not be formed with grooves or spacers.

In the above-described coaxial flat cable 210, the pitch of the plural coaxial cables 211 is fixed to the prescribed value by fastening, to the exposed portions of the outer conductors 214 of the coaxial cables 211, the ground bar 216 having the lock nails 223 capable of locking the coaxial cables 211 individually. Therefore, the structure of the connection portion can be made simpler than in a conventional electric connector in which the center conductors are connected to connection terminals. Since the positions of the exposed portions of the center conductors 212 are restricted by the first cover member 220 so that they have the prescribed pitch, the exposed portions of the center conductors 212 can be held so as to have the prescribed pitch even during use, a transport, or the like. Since the exposed portions of the center conductors 212 are flat, surface contact is made when the exposed portions of the center conductors 212 are positioned by the first cover member 220, as a result of which the exposed portions of the center conductors 212 can be bonded reliably. Furthermore, since the other surfaces, covered with the second cover member 221 in such a manner that parts of them are accessible, of the exposed portions of the center conductors 212 are also flat, surface contact is made when terminals are connected to the other surfaces, whereby stable electrical connections can be attained. Still further, since the center conductors 212 can be connected directly to a substrate or the like unlike in a conventional case in which they are connected to connection terminals, the connection portion is made simpler in structure and more compact. The coaxial flat cable 210 can be connected reliably even in a narrow connection space.

Next, a manufacturing method of the coaxial flat cable 210 according to the third embodiment of the invention will be described.

FIGS. 16(A)-16(C) are plan views and sectional views showing a manufacturing method. Members of the coaxial flat cable 210 that appeared in the above description will be given the same reference symbols as in the above description, and they will not be described redundantly.

First, as shown in FIG. 16(A), plural coaxial cables 211 (only two coaxial cables 211 are shown in the figure) are set parallel with each other, slits are formed in their outer sheaths 215 by laser burning, and tip portions of the sheaths 215 are removed simultaneously. Likewise, slits are formed in the outer conductors 214 and the insulators 213 by laser burning, and their tip portions are removed simultaneously, whereby portions, having prescribed lengths, of the outer conductor 214, the insulator 213, and the center conductor 212 of each coaxial cable 211 are exposed in this order in a step-like manner. In a positioning step, the exposed portions of the outer conductors 213 are placed in the grooves between the lock nails 223 (see FIG. 14) of a ground bar 216 and are positioned so as to have a prescribed pitch. At the same time, a pressing member 217 is applied from above and the ground bar 216 and the pressing member 217 are fastened to the coaxial cables 211 with solder, a conductive adhesive, or the like in a state that portions of the center conductors 212 of the coaxial cables 211 project forward from the ground bar 216 and the pressing member 217. Then, as shown in FIG. 16(B), in a flattening step, exposed portions, excluding tip portions 212*a*, of the center conductors 212 and short tip portions of the insulators 213 (i.e., the portions in a region R) are flattened by rolling or pressing. Then, as shown in FIG. 16(C), in a covering step, a reinforcement member 222 is placed beneath flat portions 212*b* of the center conductors 212 and a first cover member 220 is bonded, from below, to the tip portions 212*a* and the flat portions 212*b* of the center conductors 212 and the rolled or pressed portions of the insulators 213, whereby the exposed portions of the center conductors 212 are fixed so as to have at a prescribed pitch. Then, a second cover member 221 is bonded to the same portions of the coaxial cables 211 from above so as to coextend with the first cover member 220. At this time, the top surfaces of parts of the flat portions 212*b* of the center conductors 212 are exposed through the window 221*a* of the second cover member 221. Finally, the first cover member 220, the center conductors 212, and the second cover member 221 are cut along a cutting line L (see FIG. 16(C)) which is located around the tip-side ends of the flat portions 212*b* of the center conductors 212, whereby a coaxial flat cable 210 as shown in FIG. 15 is produced.

In the above-described manufacturing method of the coaxial flat cable 210, the pitch of the plural coaxial cables 211 is fixed at the prescribed value by fastening, to the exposed portions of the outer conductors 214 of the coaxial cables 211, the ground bar 216 having the lock nails 223 capable of locking the coaxial cables 211 individually. Therefore, the structure of the connection portion can be made simpler than in a conventional electric connector in which the center conductors are connected to connection terminals. Since the flat portions 212*b* are formed by rolling or pressing the exposed portions of the center conductors 212, surface contact is made when the exposed portions of the center conductors 212 are positioned by the first cover member 220, as a result of which the exposed portions of the center conductors 212 can be bonded reliably. Since the exposed portions of the center conductors 212 are sandwiched between the first cover member 220 and the second cover member 221 which coextend with each other, movement of the exposed portions of the center conductors 212 can be prevented more reliably. Furthermore, since the other surfaces, covered with the second cover member 221 in such a manner that parts of them are accessible, of the exposed portions of the center conductors 212 are also flat, surface contact is made when terminals are connected to the other surfaces, whereby stable connections can be attained. Still further, since the flat portions 212*b* of the center conductors 212 are supported by the reinforcement member 222 from below and high rigidity is thereby secured, the portion including the insulating cover members 220 and 221 can be used as if it were a connector.

In a manufacturing method of the coaxial flat cable 210A according to the second embodiment, basically the above-described flattening step is not necessary. However, also in the first embodiment, the exposed portions of the center conductors 212A may be flattened by executing a flattening step by performing rolling or pressing. In such a case, surface contact is made when the exposed portions of the center conductors 212A are positioned by the insulating cover members 230, whereby the exposed portions of the center conductors 212A can be bonded reliably. Furthermore, surface contact is also made when the center conductors 212A are connected to terminals, whereby stable connections can be attained.

In the covering step, in the case where the insulating cover member 230 is provided only on one side of the parallel arrangement plane, the single insulating cover member 230 is stuck to the exposed portions of the center conductors 212A. Where the insulating cover members 230 are provided on both sides of the parallel arrangement plane, they are stuck to the exposed portions of the center conductors 212A from both sides of the parallel plane. As a result, the exposed portions of the center conductors 212A can be fixed at the prescribed pitch.

In the covering step, if necessary, a reinforcement member may be interposed between the insulating cover member 230 and the exposed portions of the center conductors 212A or stuck to the bottom surface of the insulating cover member 230 (i.e., on the opposite side to the center conductors 212A).

Forth Embodiment

Next, a coaxial flat cable according to a forth embodiment of the invention will be described.

Figure 17:
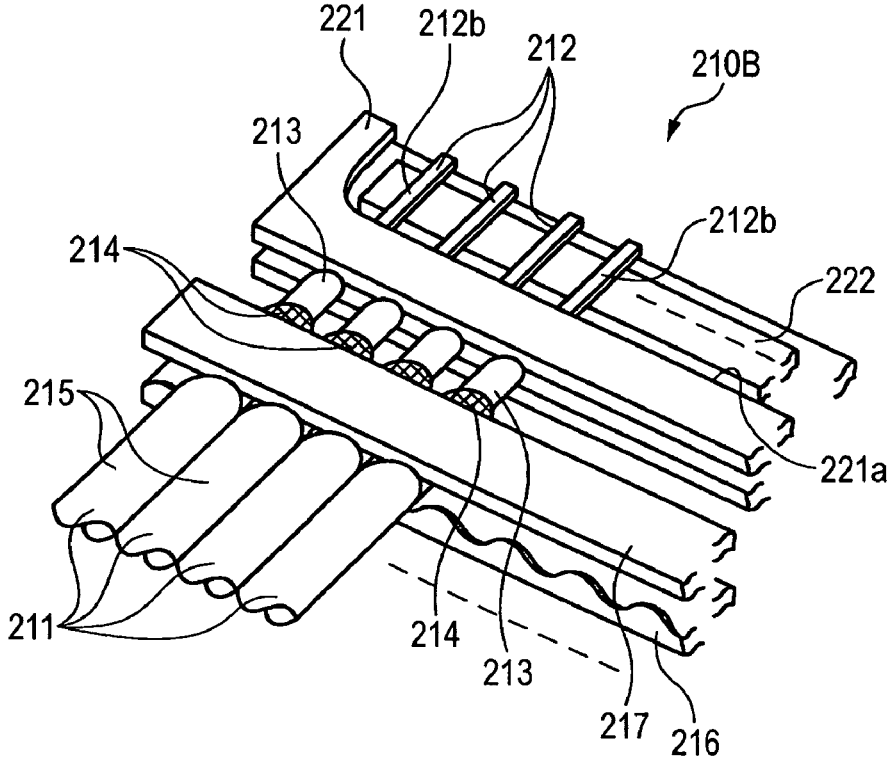
FIG. 17 is a perspective view of a coaxial flat cable according to a forth embodiment of the invention.

FIG. 17 is a perspective view of a coaxial flat cable according to the forth embodiment of the invention. Members having the same members in the second or third embodiment will be given the same reference symbols as the latter and will not be described redundantly.

As shown in FIG. 17, this coaxial flat cable 210B is such that the above-described cutting line L (see FIG. 16(C)) is set at such a position as to pass through the window 221*a* of the second cover member 221 rather than near the tips. As a result, the top surfaces of the flat portions 212*b* of the center conductors 212 are exposed upward through the window 221*a* of the second cover member 221 and the tip faces of the flat portions 212*b* are exposed above the first cover member 220.

Even with this modification, the same advantages as obtained by the above embodiments can still be obtained. Furthermore, this modification makes it easier to connect terminals to the center conductors 212 from the front side.

The coaxial flat cable 210B can be manufactured in entirely the same manner as in the manufacturing method of the coaxial flat cable 210 according to the third embodiment except for the step relating to the above-described modification.

Fifth Embodiment

Next, a coaxial flat cable according to a fifth embodiment of the invention will be described.

Figure 18:
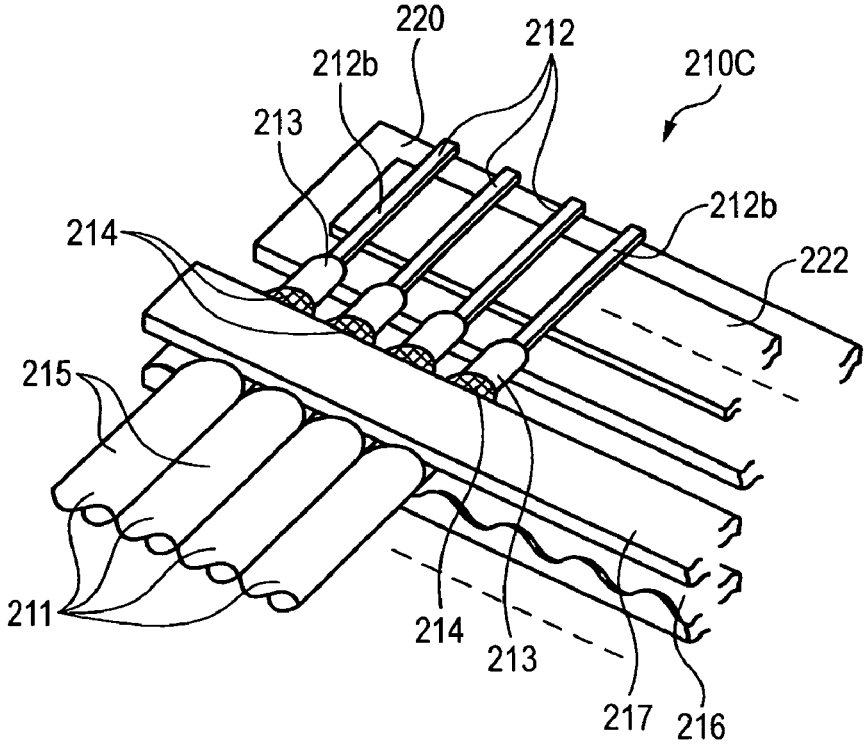
FIG. 18 is a perspective view of a coaxial flat cable according to a fifth embodiment of the invention.

FIG. 18 is a perspective view of a coaxial flat cable according to the fifth embodiment of the invention. Members having the same members in the second, third or forth embodiment will be given the same reference symbols as the latter and will not be described redundantly.

As shown in FIG. 18, this coaxial flat cable 210C is such that the second cover member 221 is omitted that is used as a cover member in the coaxial flat cable 210 according to the second embodiment and in the coaxial flat cable 210B according to the third embodiment. As a result, the exposed portions of the center conductors 212 are fixed being bonded to only the lower, first cover member 220. The top surfaces of the flat portions 12*b* of the center conductors 212 are exposed above.

Even with this modification, the same advantages as obtained by the above embodiments can still be obtained. Furthermore, this modification makes it easier to connect terminals to the center conductors 212 from the front side.

The coaxial flat cable 210C can be manufactured in entirely the same manner as in the manufacturing method of the coaxial flat cable 210 according to the third embodiment except for the step of providing the second cover member 221.

The invention is not limited to the coaxial flat cables and their manufacturing methods according to the embodiments, and modifications, improvements, etc. can be made as appropriate.

For example, whereas the above-described first cover member 220 and second cover member 221 are made of an epoxy resin which is a thermosetting resin and are set by heating them, they may be made of a thermoplastic resin such as polyethylene or polypropylene so as to be bonded through melting by heating them.

In the third embodiment (coaxial flat cable 210), the forth embodiment (coaxial flat cable 210B), and the fifth embodiment (coaxial flat cable 210C), the coaxial cables 211A having the unflattened center conductors 212A that are used in the second embodiment (coaxial flat cable 210A) may be used in place of the coaxial cables 211 having the flattened center conductors 212.

Furthermore, the center conductors 212A of the coaxial flat cable 210A used in the second embodiment may be flattened.

As described above, the coaxial cable according to the invention provides the advantages that the center conductors can be connected directly to a substrate or the like (an electric connector having connection terminals is omitted), the connection portion is made simpler in structure and more compact, and the coaxial cable can be connected even in a narrow connection space. As such, the invention is useful in providing, for example, a coaxial cable capable of connecting the center conductors directly to, for example, interconnections provided on a substrate, as well as its manufacturing method.

As described above, in the coaxial flat cable and its manufacturing method according to the invention, since the coaxial cables are positioned by fastening the ground bar to the exposed portions of the outer conductors of the coaxial cables, the structure of the connection portion can be made simpler than in a conventional electric connector. Since the positions of the exposed portions of the center conductors are restricted by the cover members so that they have the prescribed pitch, the exposed portions of the center conductors can be held so as to have the prescribed pitch even during use, a transport, or the like. Where the exposed portions of the center conductors are flat, surface contact is made when the exposed portions of the center conductors are positioned by the cover member, as a result of which the exposed portions of the center conductors can be bonded reliably. Furthermore, since the other surfaces, covered with the cover member in such a manner that parts of them are accessible, of the exposed portions of the center conductors are also flat, stable connections can be attained when terminals are connected to the other surfaces. Still further, since the center conductors can be connected directly to a substrate or the like unlike in a conventional case in which they are connected to connection terminals, advantages are obtained that the connection portion is made simpler in structure and more compact, and that the coaxial flat cable can therefore be connected reliably even in a narrow connection space. As such, the invention is useful in providing, for example, a coaxial flat cable capable of connecting plural coaxial cables directly to, for example, interconnections provided on a substrate without intervention of a connector, as well as its manufacturing method.

What is claimed is:

1. A coaxial flat cable comprising:

plural coaxial cables arranged in parallel with each other in each of which a tip portion of an outer sheath is removed and portions of an outer conductor, an insulator, and a center conductor are exposed in this order in a step-like manner;

a conductor ground bar having a first row and a second row of lock projections, each of the lock projections locking each of the coaxial cables individually, the conductor ground bar being fastened to the exposed portions of the outer conductors to fix a pitch of the plural coaxial cables, wherein the center conductors are arranged at approximately equal intervals, the coaxial cables are sandwiched to be fixed by a pressing member and the conductor ground bar, and the first row of the lock projections locks the outer conductors and the second row of the lock projections locks the outer sheaths or the insulators.

2. A coaxial flat cable comprising:

plural coaxial cables arranged parallel with each other in each of which a tip portion of an outer sheath is removed and portions of an outer conductor, an insulator, and a center conductor are exposed in this order in a step-like manner;

a ground bar having lock projections, each of the lock projections locking each of the coaxial cables individually, the ground bar being fastened to the exposed portions of the outer conductors to fix a pitch of the coaxial cables, wherein the center conductors are arranged at approximately equal intervals, the exposed portions of the center conductors are bonded to at least one of insulating cover members, the exposed portions of the center conductors are bonded to the insulating cover members from both side of a parallel arrangement plane of the center conductors, and at least one of the insulating cover members has a window through which parts of the exposed portions of the center conductors are accessible.

3. The coaxial flat cable according to claim 2, wherein only one of the insulating cover members has a window, and a reinforcement member is stuck to the insulating cover member not having a window.

4. The coaxial flat cable according to claim 3, wherein the reinforcement member is interposed between the exposed portions of the center conductors and the insulating cover member, and the reinforcement member is formed with grooves or spacers for fixing the exposed portions of the center conductors at a prescribed pitch.

5. A coaxial flat cable comprising:

plural coaxial cables arranged parallel with each other in each of which a tip portion of an outer sheath is removed and portions of an outer conductor, an insulator, and a center conductor are exposed in this order in a step-like manner;

a ground bar having lock projections, each of the lock projections locking each of the coaxial cables individually, the ground bar being fastened to the exposed portions of the outer conductors to fix a pitch of the coaxial cables; wherein each of the exposed portions of the center conductors has two flat surfaces that are parallel with a parallel arrangement plane of the center conductors, both flat surfaces of each center conductor are covered with respective insulating cover members, and at least one of the insulating cover members adjacent to one of the flat surfaces has a window through which parts of the exposed portions of the center conductors are accessible.

6. The coaxial flat cable according to claim 5, wherein tip portions of the center conductors are cut away to produce tip faces that are flush with each other so that the center conductors do not project from the insulating cover members.

7. The coaxial flat cable according to claim 5, wherein only the insulating cover member adjacent to the one flat surfaces has a window, and a reinforcement member is interposed between the other insulating cover member and the exposed portions of the center conductors.

8. A manufacturing method of a coaxial flat cable, comprising the steps of:

removing a tip portion of an outer sheath of each of plural coaxial cables and exposing portions, having prescribed lengths, of an outer conductor, an insulator, and a center conductor in this order in a step-like manner;

locking the exposed portions of at least the outer conductors by lock projections of a ground bar to position the coaxial cables at a prescribed pitch;

fastening the ground bar to the exposed portions of the outer conductors in a state that the center conductors are arranged at approximately equal intervals;

rolling at least the exposed portions of the center conductors from both side of a parallel arrangement plane of the center conductors so as to produce a first and a second flat surfaces thereby flattening the exposed portions of the center conductors so that flattened surfaces are made parallel with a parallel arrangement plane of the center conductors;

covering the first flat surface of the center conductors with a first insulating cover member; and covering the second flat surface with a second insulating cover member having a window for rendering parts of the exposed portions of the center conductors accessible, wherein the exposed portions of the center conductors are bonded to the first and the second insulating cover members.

9. The manufacturing method according to claim 8, wherein after both flat surfaces of each center conductor are covered with the first and the second insulating cover members, respectively, tip portions of the center conductors are cut away to produce tip faces that are flush with each other so that the center conductors do not project from the first and the second insulating cover members.

10. The manufacturing method according to claim 8, wherein the first insulating cover member covering the center conductors does not have a window, and a reinforcement member is interposed between the exposed portions of the center conductors and the first insulating cover member not having a window.

* * * * *